US008026668B2

(12) United States Patent
Itakura et al.

(10) Patent No.: US 8,026,668 B2
(45) Date of Patent: Sep. 27, 2011

(54) PLASMA DISPLAY PANEL AND METHOD FOR DRIVING SAME

(75) Inventors: Shunsuke Itakura, Yamanashi (JP); Hai Lin, Yamanashi (JP); Atsushi Hirota, Yamanashi (JP)

(73) Assignee: Panasonic Corporation, Kadoma-shi (JP)

( * ) Notice: Subject to any disclaimer, the term of this patent is extended or adjusted under 35 U.S.C. 154(b) by 425 days.

(21) Appl. No.: 11/971,489

(22) Filed: Jan. 9, 2008

(65) Prior Publication Data

US 2008/0174244 A1 Jul. 24, 2008

(30) Foreign Application Priority Data

Jan. 23, 2007 (JP) ..... 2007-012182
May 11, 2007 (JP) ..... 2007-126374

(51) Int. Cl.
*H01J 17/49* (2006.01)

(52) U.S. Cl. ..... 313/582; 313/583; 313/584; 313/585; 313/587

(58) Field of Classification Search ..... 313/582–587; 445/24–25
See application file for complete search history.

(56) References Cited

U.S. PATENT DOCUMENTS

| | | | | |
|---|---|---|---|---|
| 2004/0075388 | A1* | 4/2004 | Miyashita et al. | 313/586 |
| 2005/0110412 | A1* | 5/2005 | Lee | 313/587 |
| 2005/0248510 | A1* | 11/2005 | Sakata et al. | 345/67 |
| 2005/0264487 | A1* | 12/2005 | Tokunaga et al. | 345/63 |
| 2006/0226760 | A1* | 10/2006 | Amatsuchi et al. | 313/487 |
| 2007/0013306 | A1* | 1/2007 | Hai et al. | 313/582 |

FOREIGN PATENT DOCUMENTS

JP 2006-294462 10/2006

* cited by examiner

*Primary Examiner* — Karabi Guharay
*Assistant Examiner* — Elmito Breval
(74) *Attorney, Agent, or Firm* — Arent Fox LLP

(57) ABSTRACT

Each of the red, green and blue phosphor layers includes magnesium oxide including a magnesium oxide crystal body having properties of causing a cathode-luminescence emission having a peak within a wavelength range of 200 nm to 300 nm upon excitation by electron beams, as a secondary electron emission.

8 Claims, 16 Drawing Sheets

FIRST EMBODIMENT

SECTION V-V

SECTION W-W

SINGLE-CRYSTAL BODY OF CUBIC
SINGLE-CRYSTALLINE STRUCTURE

MgO SINGLE-CRYSTAL BODY OF CUBIC POLYCRYSTALLINE STRUCTURE

DISCHARGE PROBABILITY(REST TIME 1000 $\mu$ sec$^{-1}$)

| | ACTUALLY MEASURED VALUE | NORMALIZATION1 | NORMALIZATION2 |
|---|---|---|---|
| POLYCRYSTALLINE STRUCTURE MgO | 89.8 | 826.4 | 39.09 |
| VAPOR DEPOSITION MgO | 2.3 | 21.1 | 1.00 |
| WITHOUT MgO | 0.1 | 1.0 | 0.05 |

DISCHARGE DELAY(REST TIME 1000 μ sec)

| | ACTUALLY MEASURED VALUE | NORMALIZATION1 | NORMALIZATION2 |
|---|---|---|---|
| POLYCRYSTALLINE STRUCTURE MgO | 0.5 | 0.01 | 0.12 |
| VAPOR DEPOSITION MgO | 4.0 | 0.06 | 1.00 |
| WITHOUT MgO | 65.0 | 1.00 | 16.25 |

SECOND EMBODIMENT

THIRD EMBODIMENT

PLASMA DISPLAY PANEL AND METHOD FOR DRIVING SAME

BACKGROUND OF THE INVENTION

1. Field of the Invention

This invention relates to the structure of plasma display panels and a method for driving the plasma display panel.

The present application claims priority from Japanese Applications Nos. 2007-012182 and 2007-126374, the disclosures of which are incorporated herein by reference.

2. Description of the Related Art

A plasma display panel (hereinafter referred to as "PDP"), typically, comprises a pair of opposing substrates placed across a discharge space. One of the opposing substrates has an inner face on which row electrode pairs, a dielectric layer overlying the row electrode pairs and a protective layer overlying the dielectric layer are provided. The other substrate has an inner face on which column electrodes, a column-electrode protective layer overlying the column electrodes and red, green and blue phosphor layers are provided. The column electrodes extend at right angles to the row electrode pairs such that discharge cells are arranged in matrix form at positions in the discharge space respectively corresponding to the intersections of the column electrodes and the row electrode pairs. The red, green and blue phosphor layers are provided individually on portions of the column-electrode protective layer respectively corresponding to the discharge cells.

The discharge space is filled with a discharge gas that includes a xenon gas. The PDP structured as described above initiates an address discharge selectively between the column electrode and one of each row electrode pair. In each of the discharge cells (light emitting cells) in which the address discharge results in the deposition of a wall charge on a portion of the dielectric layer facing the discharge cell, a sustain discharge is produced between the row electrodes of the row electrode pair.

The sustain discharge results in the emission of vacuum ultraviolet light from the xenon gas in the discharge gas. The vacuum ultraviolet light excites the phosphor layers in the respective light emitting cells, thus causing the phosphor layers to emit visible light in red, green and blue colors to generate an image on the panel screen in accordance with a video signal.

The conventionally known phosphors, which emit visible light when being excited by ultraviolet light in a PDP as described above, include $(Y, Gd)BO_3$:Eu as a phosphor emitting red light, $Zn_2SiO_4$:Mn as a phosphor emitting green light (hereinafter referred to as "green phosphor"), and $BaMgAl_{10}O_{17}$:Eu as a phosphor emitting blue light. In addition, $MgAl_2O_4$:Mn and the like are known as green phosphors. These red, green and blue phosphors differ from each other in electrification property and electrostatic capacity, so that variations in discharge intensity occur among the red, green and blue discharge cells.

For this reason, the PDP has, for example, difficulty in producing a pure white display when a discharge is initiated in all the red, green and blue discharge cells together to cause visible light emission for a white display.

In a conventional PDP proposed for overcoming such a disadvantage, for the purpose of lessening the variations in discharge intensity in the discharge cells in which the red, green and blue phosphor layers are respectively provided, a crystalline magnesium oxide layer including a magnesium oxide crystal body that causes a cathode-luminescence emission having a peak within a wavelength range of 200 nm to 300 nm upon excitation by electron beams is deposited on a portion of the dielectric layer facing each of the discharge cells in which the red, green and blue phosphor layers are respectively provided. In addition, one or more of the red, green and blue phosphor layers are mixed with silicon dioxide, aluminum, magnesium or lanthanum, and/or one or more of the red, green and blue phosphor layers is designed to differ in film thickness from the remainder.

Such a PDP is disclosed in Japanese Unexamined Patent Publication 2006-294462, for example.

This conventional PDP restrains the occurrence of variations in the discharge intensity in the discharge cells in which the red, green and blue phosphor layers are respectively provided. As a result, for example, when a discharge is initiated in all the red, green and blue discharge cells together for light emission, the disadvantages relating to the white display and the like are solved to some extent.

In recent years, with an increase in definition on a screen such as a full HD screen, there has been an increasingly strong request that the PDP as described above be developed to a PDP that is capable of achieving the prevention of a reduction in dark contrast caused by a reset discharge (a discharge for initializing all the discharge cells) produced in the discharge cells when the PDP is operated, and an increase in the margin of discharge voltage, and also a clearer pure white display.

SUMMARY OF THE INVENTION

It is a technical object of the present invention to respond to the requests for PDPs as described above.

To attain this object, in an aspect of the present invention, a PDP comprises a pair of substrates placed across a discharge space, a plurality of row electrode pairs provided on one of the pair of substrates, a plurality of column electrodes provided on the other substrate and extending in a direction at right angles to the row electrode pairs to form unit light emission areas in the discharge space respectively corresponding to the intersections with the row electrode pairs, and phosphor layers of red, green and blue colors provided in respective positions facing the respective unit light emission areas between the column electrodes and the row electrode pairs, each of the red phosphor layers being formed of a red phosphor material and making a red unit light mission area of the corresponding unit light emission area, each of the green phosphor layers being formed of a green phosphor material and making a green unit light emission area of the corresponding unit light emission area, and each of the blue phosphor layers being formed of a blue phosphor material and making a blue unit light emission area of the corresponding unit light emission area, wherein each of the phosphor layers includes a secondary electron emission material, the secondary electron emission material is magnesium oxide including a magnesium oxide crystal body having properties of causing a cathode-luminescence emission having a peak within a wavelength range of 200 nm to 300 nm upon excitation by electron beams, and the phosphor layer of a required color of the red, green and blue phosphor layers includes a different amount of the secondary electron emission material than the phosphor layers of the remaining colors.

To attain the above object, in another aspect of the present invention, a method of operating a PDP comprises the step of, in the PDP described above, applying a voltage pulse to one row electrode of each of the row electrode pairs and setting the potential of the corresponding column electrode to be negative relative to the row electrode to which the voltage pulse is applied to initiate an opposing discharge between the column electrode and the row electrode.

In the PDP according to the present invention, the phosphor layer placed facing the unit light emission area includes a secondary electron emission material, and an opposing discharge is initiated between one row electrode of each row electrode pair and the column electrode which are positioned on either side of the phosphor layer. Because of this design, upon the discharge occurrence, positive ions generated from the discharge gas in the unit light emission area collide with the secondary electron emission material included in the phosphor layer, whereupon secondary electrons are emitted from the secondary electron emission material into the unit light emission area.

Thus, the secondary electrons existing in the unit light emission area facilitate occurrence of a discharge initiated subsequent to the opposing discharge between the row electrode and the column electrode, resulting in a reduction for the breakdown voltage for the discharge.

In the case when the opposing discharge produced between the row electrode and the column electrode is a reset discharge for initializing all the unit light emission areas in the operation of the PDP, the opposing discharge occurs approximately in a central portion of the unit light emission area distant from the substrate of the pair of substrates which constitutes the panel screen of the PDP. For this reason, as compared with the case when the reset discharge is provided by a surface discharge initiated between the row electrodes in a position close to the panel screen, the amount of light emission caused by the reset discharge and observed on the panel screen is reduced. In consequence, the dark contrast is prevented from being reduced by the light emission caused by the reset discharge and unrelated to gradation display of an image, leading to an improvement in dark contrast of the PDP.

In addition, for the phosphor layer of the PDP according to the present invention, the red phosphor layer, the green phosphor layer and the blue phosphor layer respectively include different amounts of the secondary electron emission material determined in accordance with the electrification properties of the phosphor materials respectively used for forming the red, green and blue phosphor layers, such that the amounts of electrification of the red, green and blue phosphor layers are adjusted to be approximately equal to each other. Because of this adjustment, the discharge voltages in the red, green and blue unit light emission areas become approximately equal to each other so as to start the discharge approximately at the same time. In consequence, an increase in discharge voltage margin is achieved, thus achieving clearer white display.

In the method of operating the PDP according to the present invention, the opposing discharge between one row electrode of each row electrode pair and the column electrode is produced by applying a voltage pulse to the row electrode and setting the potential of the column electrode to be negative relative to the row electrode receiving the voltage pulse. By the opposing discharge, the positive ions are produced from the discharge gas. The positive ions travel toward the negative column electrode and collide with the secondary electron emission material included in the phosphor layer. Because of this collision, secondary electrons are effectively emitted into the unit light emission area from the secondary electron emission material.

In the PDP and the operating method according to the present invention, the amount of the secondary electron emission material included in the green phosphor layer is preferably larger than the amount of the secondary electron emission material included in each of the red and blue phosphor layers.

As a result, the amount of electrification of the green phosphor layer formed of the green phosphor material which is typically low in the amount of electrification is increased relative to those of the red and blue phosphor layers, so as to reduce the discharge voltage. This makes it possible to initiate the opposing discharge on the phosphor layers of all the three colors approximately at the same time.

In the PDP and the operating method according to the present invention, the secondary electron emission material is preferably exposed into the inside of each of the unit light emission areas from the phosphor layer.

This design fulfills an effective collision of the secondary electron emission material included in the phosphor layer with the positive ions, which makes it possible to more effectively emit the secondary electrons into the unit light emission area.

In the PDP and the operating method according to the present invention, examples of how to combine the phosphor layer with the secondary electron emission material include to mix the secondary electron emission material in the phosphor material of the phosphor layer, and to shape the secondary electron emission material into a layer and then stack the layer on a layer formed of the phosphor material of the phosphor layer.

In the PDP and the operating method according to the present invention, the use of magnesium oxide as the secondary electron emission material is preferable, and makes it possible to effectively emit the second electrons from the phosphor layer into the unit light emission area.

In the PDP and the driving method according to the present invention, a preferable material used as the secondary electrons emission material is magnesium oxide including a magnesium oxide crystal body having properties of causing a cathode-luminescence emission having a peak within a wavelength range of 200 nm to 300 nm, more preferably, of 230 nm to 250 nm, upon excitation by electron beams, more particularly, a magnesium oxide single-crystal body produced by a vapor-phase oxidization technique.

Accordingly, a reduction in discharge intensity and discharge delay in the opposing discharge initiated between the row electrode and the column electrode is made possible, leading to an improvement in luminance of the PDP.

In the PDP and the driving method according to the present invention, the opposing discharge initiated between the row electrode and the column electrode is preferably produced for the reset discharge for initializing the unit light emission areas.

Because of this design, the reset discharge occurs approximately in a central portion of the unit light emission area distant from the substrate of the pair of substrate constituting the panel screen of the PDP. Accordingly, as compared with the case of the reset discharge provided by the surface discharge initiated between the row electrodes close to the panel screen, the amount of light emission caused by the reset discharge observed on the panel screen is reduced. As a result, the dark contrast is prevented from being reduced by the light emission caused by the reset discharge unrelated to the gradation display of an image, leading to an improvement in dark contrast of the PDP.

In the PDP and the operating method according to the present invention, preferably, a positive voltage pulse is applied to one row electrode of each row electrode pair, and a negative voltage pulse is applied to the column electrode or the column electrode may be maintained at a ground potential.

This enables occurrence of a so-called negative column-electrode discharge between the row electrode and the column electrode, in which the positive ions produced from the discharge gas by the discharge travel toward the negative column electrode.

In the PDP and the operating method according to the present invention, at the same time when the voltage pulse is applied to one row electrode of each row electrode pair, a voltage pulse having the same polarity as that of the voltage pulse applied to the row electrode and a potential at which a discharge is not caused between the row electrodes of the row electrode pair is preferably applied to the other row electrode of the row electrode pair.

As a result, a discharge is prevented from being initiated between the row electrodes of each row electrode pair, so as to enable reliable initiation of the opposing discharge between the row electrode and the column electrode.

In the PDP and the operating method according to the present invention, the voltage pulse is preferably applied to the row electrode in conditions that the voltage increases at a required rate of increase from the application start.

Because of this, the opposing discharge is initiated when the voltage on the rise of the voltage pulse does not much increase, making it possible to reduce the discharge intensity of the opposing discharge.

In the PDP and the operating method according to the present invention, preferably, the amounts of the secondary electron emission material respectively included in the red phosphor layer, the green phosphor layer and the blue phosphor layer are respectively set to values that allow a breakdown voltage for a discharge initiated across the red unit light emission area between one row electrode of each row electrode pair and the column electrode, a breakdown voltage for a discharge initiated across the green unit light emission area between the row electrode and the column electrode, a breakdown voltage for a discharge initiated across the blue unit light emission area between the row electrode and the column electrode to establish a relationship of (the breakdown voltage for a discharge across the green unit light emission area)≧(the breakdown voltage for a discharge across the red unit light emission area)≧(the breakdown voltage for a discharge across the blue unit light emission area).

Because of this deign, the amounts of the secondary electron emission material respectively included in the red phosphor layer, the green phosphor layer and the blue phosphor layer are set such that the breakdown voltages for the opposing discharge across the phosphor layers in the unit light emission areas in which the red, green and blue phosphor layers are respectively provided maintain the relationship (the breakdown voltage for a discharge across the green unit light emission area)≧(the breakdown voltage for a discharge across the red unit light emission area)≧(the breakdown voltage for a discharge across the blue unit light emission area), within the range that the breakdown voltages are considered to be approximately equal to each other. In consequence, even if a larger amount of the secondary electron emission material is mixed in the green phosphor layer than that mixed in the red phosphor layer and the blue phosphor layer, it is possible to prevent the viewer from sensing high black-level luminance at the time of initiating the opposing discharge such as the reset discharge through the phosphor layer, resulting in a reduction in dark contrast.

These and other objects and features of the present invention will become more apparent from the following detailed description with reference to the accompanying drawings.

DETAILED DESCRIPTION OF THE PREFERRED EMBODIMENTS

First Embodiment

Figure 1:
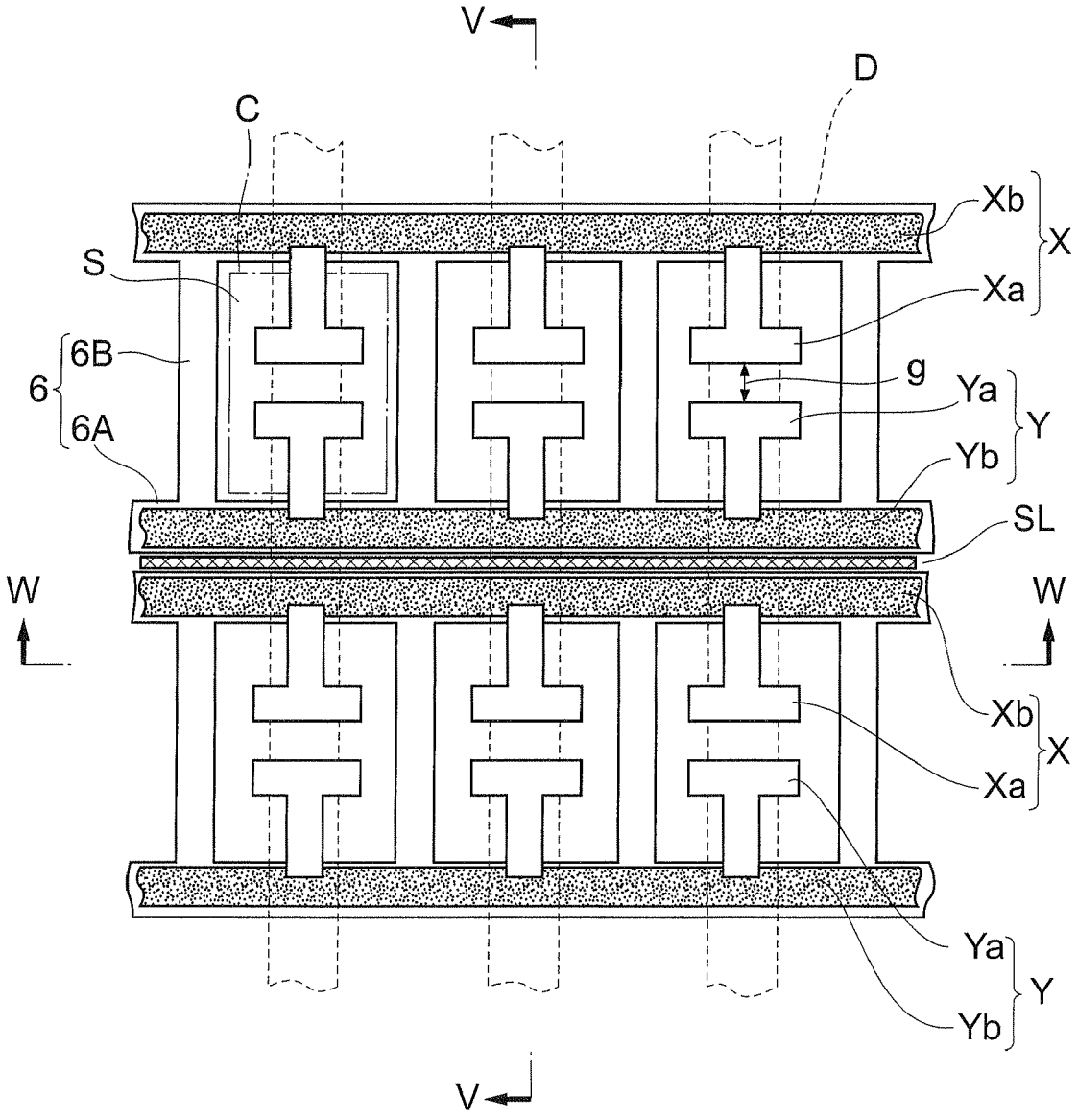
FIG. 1 is a front view illustrating an example of a first embodiment according to the present invention.
Figure 2:
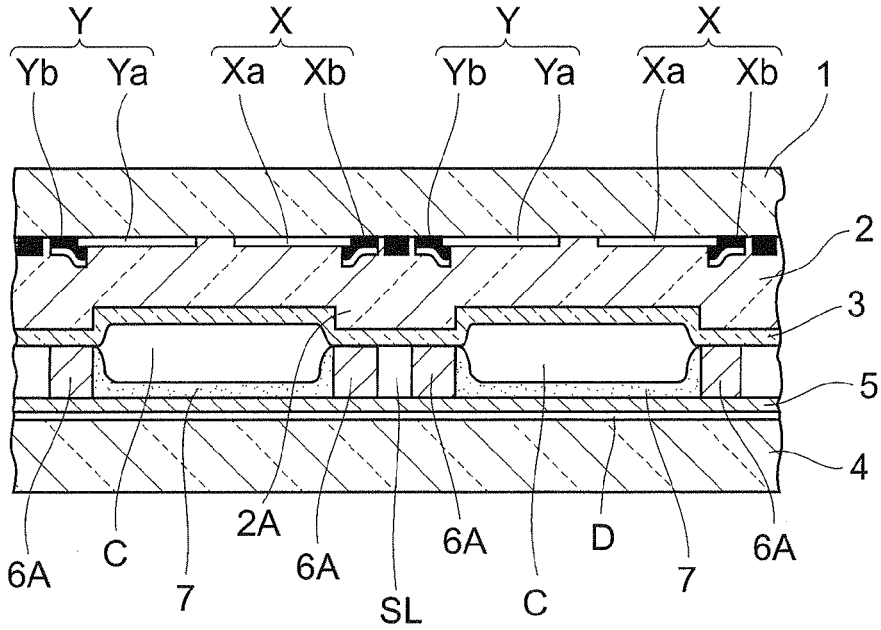
FIG. 2 is a sectional view taken along the V-V line in FIG. 1.
Figure 3:
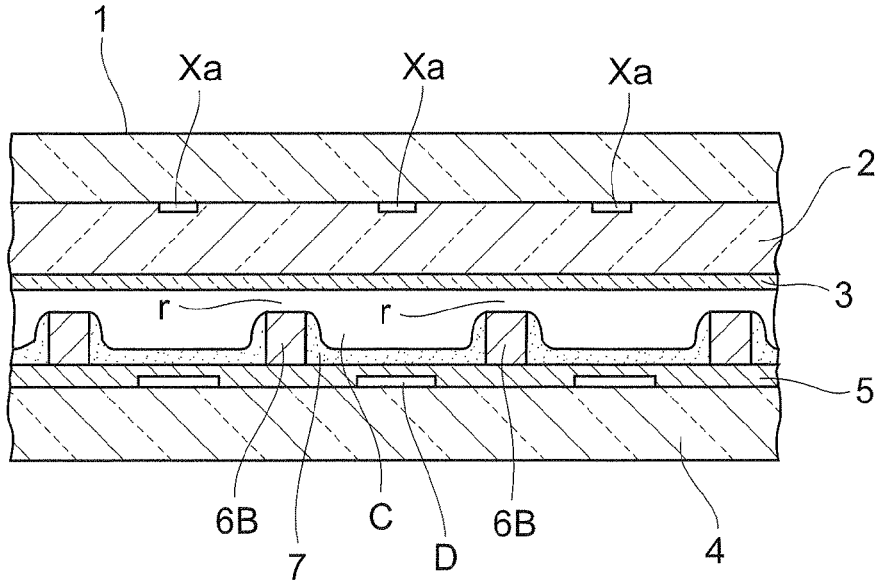
FIG. 3 is a sectional view taken along the W-W line in FIG. 1.

FIGS. 1 to 3 illustrate a first embodiment of the PDP according to the present invention. FIG. 1 is a schematic front view of the PDP in the first embodiment. FIG. 2 is a sectional view taken along the V-V line in FIG. 1. FIG. 3 is a sectional view taken along the W-W line in FIG. 1.

The PDP in FIGS. 1 to 3 has a plurality of row electrode pairs (X, Y) arranged in parallel on the rear-facing face (the face facing toward the rear of the PDP) of a front glass substrate 1 serving as the display surface so as to extend in the row direction of the front glass substrate 1 (the right-left direction in FIG. 1).

A row electrode X is composed of T-shaped transparent electrodes Xa formed of a transparent conductive film made of ITO or the like, and a bus electrode Xb formed of a metal film extending in the row direction of the front glass substrate 1 and connected to the narrow proximal ends of the transparent electrodes Xa.

Likewise, a row electrode Y is composed of T-shaped transparent electrodes Ya formed of a transparent conductive film made of ITO or the like, and a bus electrode Yb formed of a metal film extending in the row direction of the front glass substrate 1 and connected to the narrow proximal ends of the transparent electrodes Ya.

The row electrodes X and Y are arranged in alternate positions in the column direction of the front glass substrate 1 (the vertical direction in FIG. 1). Each of the transparent electrodes Xa and Ya, which are regularly spaced along the corresponding bus electrodes Xb and Yb facing each other in each row electrode pair, extends out from the bus electrode toward its counterpart in the row electrode pair, so that the wide distal ends of the transparent electrodes Xa and Ya face each other across a discharge gap g having a required width.

A dielectric layer 2 is formed on the rear-facing face of the front glass substrate 1 so as to overlie the row electrode pairs (X, Y). Additional dielectric layers 2A are deposited on the rear-facing face of the dielectric layer 2 so as to project therefrom toward the rear of the PDP. Each of the additional dielectric layers 2A extends parallel to the back-to-back bus electrodes Xb, Yb of the adjacent row electrode pairs (X, Y) on a portion of the dielectric layer 2 facing these bus electrodes Xb, Yb and facing the area between these bus electrodes Xb, Yb.

A magnesium oxide layer 3 is deposited on the rear-facing faces of the dielectric layer 2 and the additional dielectric layers 2A. The magnesium oxide layer 3 includes a magnesium oxide crystal body that causes a cathode-luminescence emission (hereinafter referred to as "CL emission") having a peak within a wavelength range of 200 nm to 300 nm upon excitation by electron beams, as described in detail later, (hereinafter referred to as "CL-emission MgO crystal body").

The front glass substrate 1 is placed parallel to a back glass substrate 4. Column electrodes D are arranged parallel to each other at predetermined intervals on the front-facing face (the face facing toward the display surface of the PDP) of the back glass substrate 4. Each of the column electrodes D extends in a direction at right angles to the row electrode pairs (X, Y) (i.e. in the column direction) on a portion of the back glass substrate 4 opposite to the paired transparent electrodes Xa and Ya of each row electrode pair (X, Y).

On the front-facing face of the back glass substrate 4, a white column-electrode protective layer 5 overlies the column electrodes D, and in turn partition wall units 6 are formed on the column-electrode protective layer 5.

Each of the partition wall units 6 is formed in an approximate ladder shape made up of a pair of transverse walls 6A and vertical walls 6B. The pair of transverse walls 6A extends in the row direction in the respective positions opposite to the bus electrodes Xb and Yb of each row electrode pair (X, Y). Each of the vertical walls 6B extends in the column direction between the pair of transverse walls 6A in a mid-position between the adjacent column electrodes D. The partition wall units 6 are regularly arranged in the column direction in such a manner as to form an interstice SL extending in the row direction between the back-to-back transverse walls 6A of the adjacent partition wall units 6.

The ladder-shaped partition wall units 6 partition the discharge space S defined between the front glass substrate 1 and the back glass substrate 4 into quadrangular areas to form discharge cells C in positions each corresponding to the paired transparent electrodes Xa and Ya of each row electrode pair (X, Y).

In each discharge cell C, a phosphor layer 7 overlies five faces facing the discharge cell C: the four side faces of the transverse walls 6A and the vertical walls 6B of the partition wall unit 6 and the face of the column-electrode protective layer 5. The three primary colors of the respective phosphor layers 7, red, green and blue, in the respective discharge cells C are arranged in order in the row direction.

The phosphor forming the phosphor layers 7 will be described later in detail.

The MgO layer 3 overlying the additional dielectric layer 2A is in contact with the front-facing face of each of the transverse walls 6A of the partition wall units 6 (see FIG. 2) to block off the discharge cell C and the interstice SL from each other. However, the MgO layer 3 is out of contact with the front-facing face of the vertical wall 6B (see FIG. 3), to form a clearance (communication portion) r therebetween, so that the adjacent discharge cells C in the row direction communicate with each other by means of the clearance r.

The discharge space S is filled with a discharge gas including a xenon gas.

Figure 4:
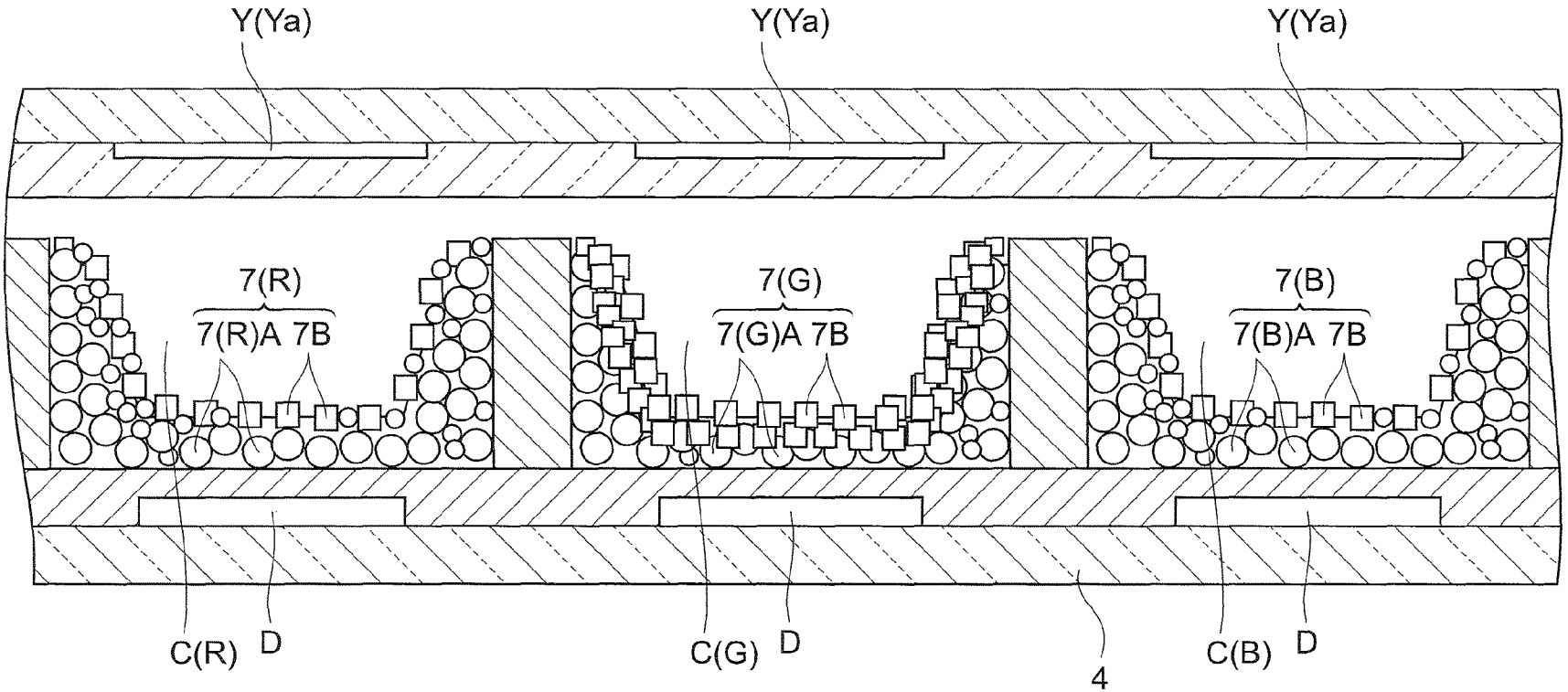
FIG. 4 is a sectional view illustrating the structure of a phosphor layer in the first embodiment.

FIG. 4 is a sectional view of the discharge cells C illustrating the structure of the phosphor layers 7.

Referring to FIG. 4, in the PDP, a red discharge cell C(R) in which a red phosphor layer 7(R) is provided for emission of red visible light when being excited by ultraviolet light, a green discharge cell C(G) in which a green phosphor layer 7(G) is provided for emission of green visible light, and a blue discharge cell C(B) in which a blue phosphor layer 7(B) is provided for emission of blue visible light, are arranged adjacent to each other in order from the left in the row direction, and the three, red, green and blue discharge cells C(R), C(G) and C(B) form a pixel. (In the following description, the red, green and blue phosphor layers will be referred to simply as "phosphor layers 7" when it is unnecessary for the description to distinguish between the phosphor layers by color.)

In the first embodiment, $(Y, Gd)BO_3$:Eu is used as the red phosphor material 7(R)A forming the red phosphor layer 7(R), $Zn_{2-x}SiO_4$:$Mn_x$ is used as the green phosphor material 7(G)A forming the green phosphor layer 7(G), and $BaMgAl_{10}O_{17}$:Eu is used as the blue phosphor material 7(B)A forming the blue phosphor layer 7(B).

In the red phosphor layer 7(R), the green phosphor layer 7(G) and the blue phosphor layer 7(B), each of the red, green and blue phosphor materials 7(R)A, 7(G)A, 7(B)A is mixed with an MgO (Magnesium Oxide) crystal 7B which is a secondary electron emission material in such a manner that the MgO crystal 7B is exposed on the surface of the corresponding phosphor layer to the inside of the corresponding discharge cell.

Although FIG. 4 illustrates the MgO crystal 7B disposed only on the surface of each of the red, green and blue phosphor layers 7(R), 7(G), 7(B), provided that the MgO crystal 7B is exposed to the inside of the corresponding discharge cell, the MgO crystal 7B may be embedded in each of the red, green and blue phosphor layers 7(R), 7(G), 7(B).

The green phosphor layer 7(G) is mixed with a greater amount of the MgO crystal 7B which is the secondary electron emission material, than that mixed in the red phosphor layer 7(R) and the blue phosphor layer 7(B).

The reason for this will be described later.

Provided that the MgO crystal 7B has the property of emitting secondary electrons, any form of MgO crystal body can be used as the MgO crystal 7B. The first embodiment employs a CL-emission MgO crystal body that has the property of causing a cathode-luminescence emission having a peak within a wavelength range of 200 nm to 300 nm upon excitation by electron beams, as in the case of the aforementioned CL-emission MgO crystal body forming the magnesium oxide layer 3.

Figure 5:
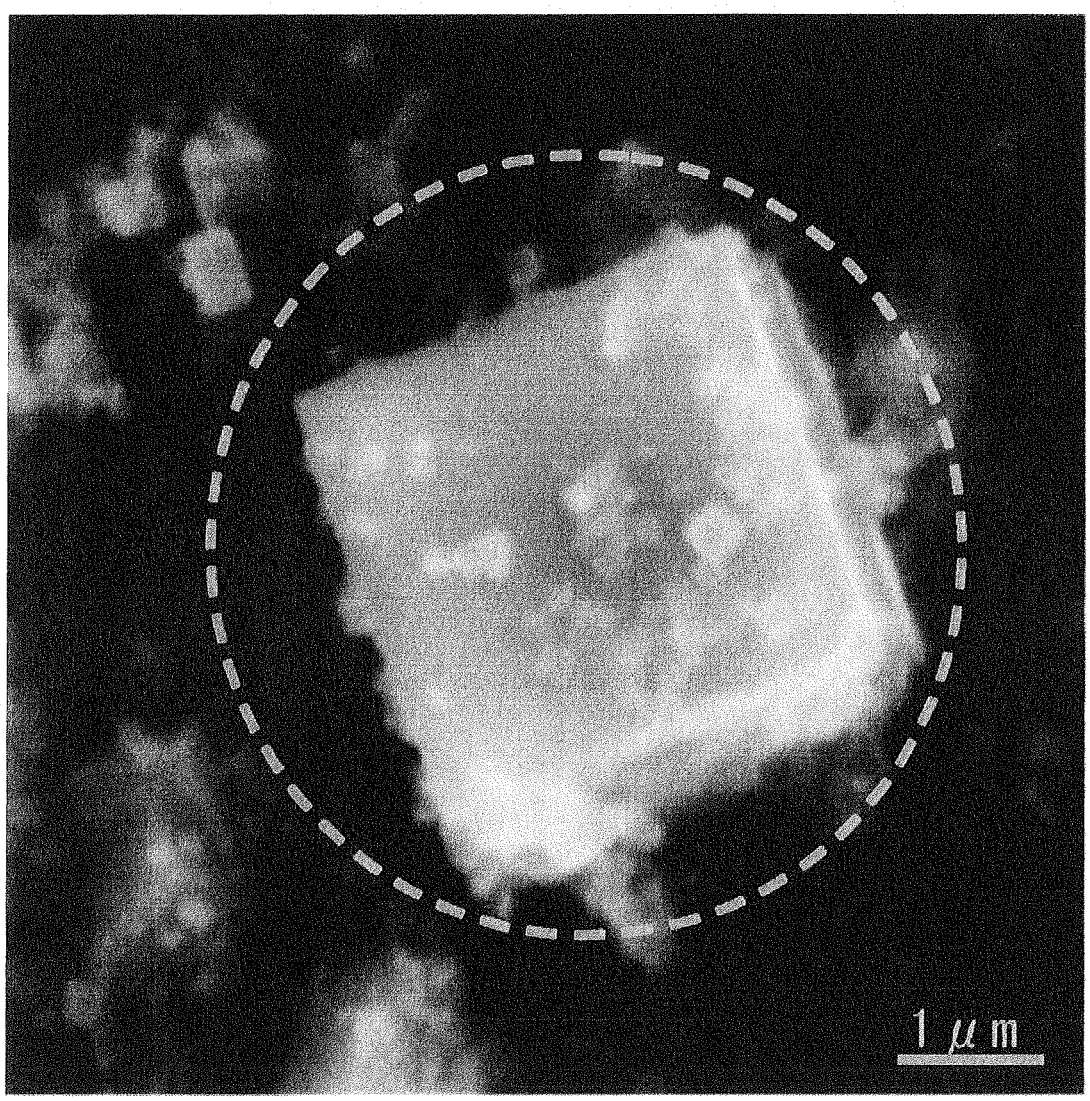
FIG. 5 is an SEN photograph of a magnesium oxide single-crystal body having a cubic single-crystalline structure.
Figure 6:
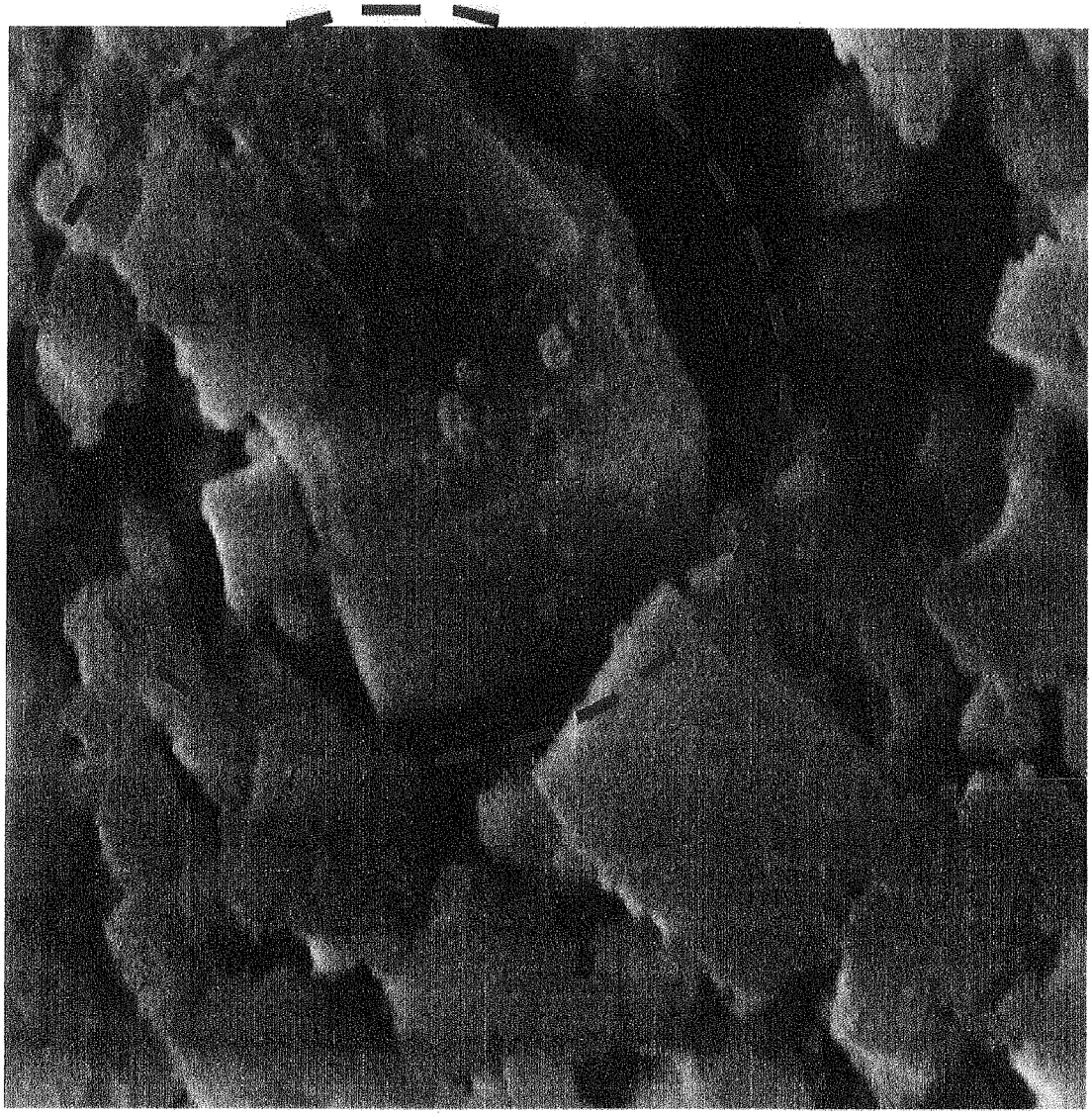
FIG. 6 is an SEN photograph of a magnesium oxide single-crystal body having a cubic polycrystalline structure.

Examples of the CL-emission MgO crystal body include a magnesium single-crystal body which is obtained by performing vapor-phase oxidization on magnesium steam generated by heating magnesium (this magnesium single-crystal body is hereinafter referred to as "a vapor-phase MgO single-crystal body"). Examples of the vapor-phase MgO single-crystal body include an MgO single-crystal body having a cubic single-crystalline structure as illustrated in the SEM photograph in FIG. 5, and an MgO single-crystal body having a structure of cubic crystal bodies fitted to each other (i.e. a cubic polycrystalline structure) as illustrated in the SEM photograph in FIG. 6.

The vapor-phase MgO single-crystal body contributes to an improvement in the discharge characteristics such as a reduction in discharge delay in the PDP as described later.

As compared with magnesium oxide obtained by other methods, the vapor-phase MgO single-crystal body has the features of being of a high purity, taking a microscopic particle form, causing less particle agglomeration, and the like.

The vapor-phase MgO single-crystal body used in the first embodiment has an average particle diameter of 2000 or more angstroms based on a measurement using the BET method.

The vapor-phase MgO single-crystal body having a large particle diameter has a property of causing excitation of a CL emission having a peak within a wavelength range from 200 nm to 300 nm (more specifically, from 230 nm to 250 nm, around 235 nm) in addition to a CL emission having a peak wavelength ranging from 300 nm to 400 nm.

Figure 9:
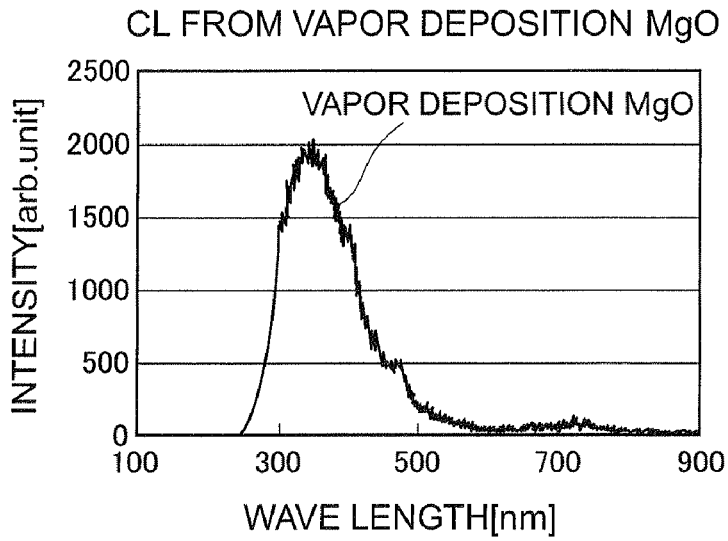
FIG. 9 is a graph showing the state of the wavelength of a CL emission from a magnesium oxide layer formed by vapor deposition.

As shown in FIG. 9, the CL emission a peak within a wavelength range from 200 nm to 300 nm (more specifically, from 230 nm to 250 nm, around 235 nm) is not excited from a typically vapor-deposited MgO, and a CL emission having a peak wavelength ranging from 300 nm to 400 nm alone is excited.

FIG. 9 shows the results of the measurement made on a MgO vapor-deposited film having a thickness of about 8000 angstroms.

Figure 7:
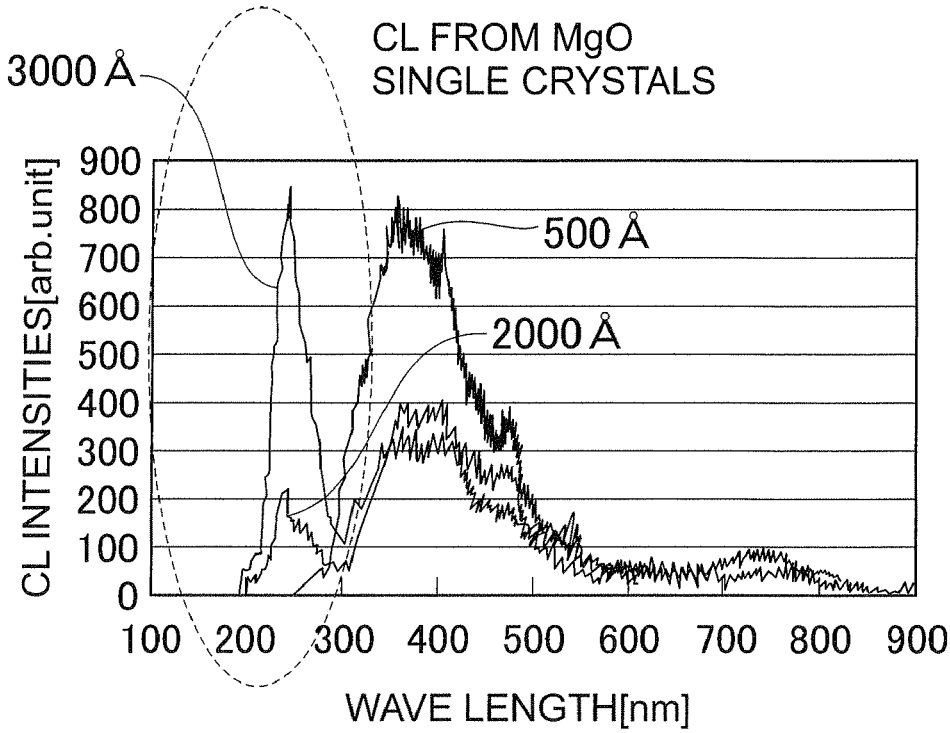
FIG. 7 is a graph showing the relationship between the particle size of a magnesium oxide single-crystal body and the wavelength and intensity of a CL emission.
Figure 8:
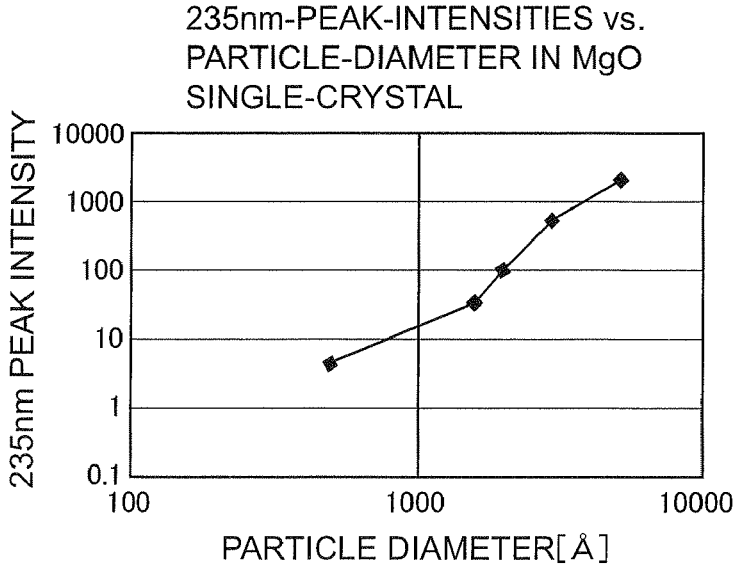
FIG. 8 is a graph showing the relationship between the particle size of the magnesium oxide single-crystal body and the peak intensity of a 235 nm CL emission.

As seen from FIGS. 7 and 8, the stronger the peak intensity of the CL emission having a peak within the wavelength range of from 200 nm to 300 nm (more particularly, 235 nm) becomes, the larger the particle diameter of the vapor-phase MgO single-crystal body.

The BET specific surface area (s) is measured by a nitrogen adsorption technique. From the measured value, the particle diameter ($D_{BET}$) of the vapor-phase MgO single-crystal body is calculated by the following equation.

$$D_{BET}=A/s\times\rho$$

where A: shape count (A=6)

ρ: real density of magnesium

Figure 10:
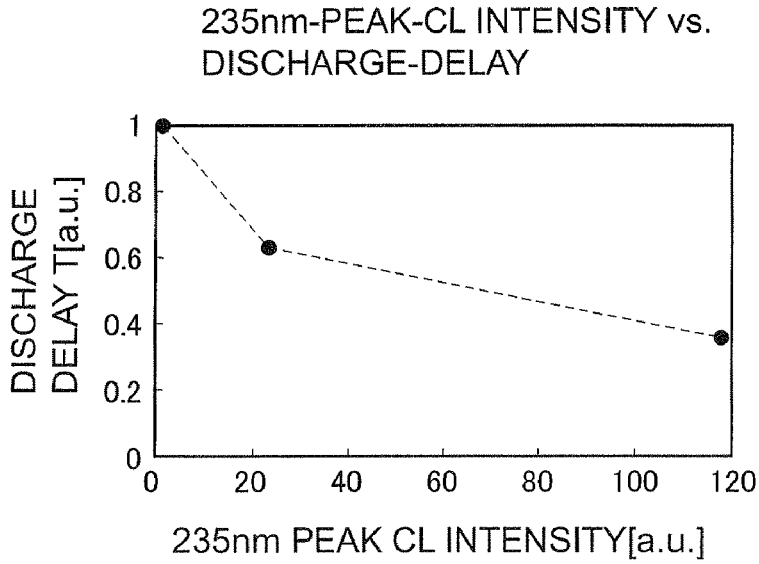
FIG. 10 is a graph showing the relationship between the discharge delay and the peak intensity of a 235 nm CL emission from a magnesium oxide single-crystal body.

FIG. 10 is a graph showing the correlation between the CL emission intensity of the vapor-phase MgO single-crystal body and the discharge delay in the PDP.

It is seen from FIG. 10 that because the vapor-phase MgO single-crystal body has the property of emitting a 235 nm CL emission, when a magnesium oxide layer including the vapor-phase MgO single-crystal body is disposed in the discharge cells of the PDP, this shortens the delay of the discharge initiated in the discharge cell, and further as the intensity of the 235 nm CL emission increases, the discharge delay time is increasingly shortened.

In turn, it is seen from the forgoing that if a vapor-phase MgO single-crystal body having an average particle diameter of 2000 or more angstroms based on a measurement using the BET method is used in areas facing the discharge cells of the PDP, it can contribute to improved discharge characteristics such as discharge probability and a discharge delay in the PDP (a reduction in discharge delay, an increase in the discharge probability).

Figures 11, 12:
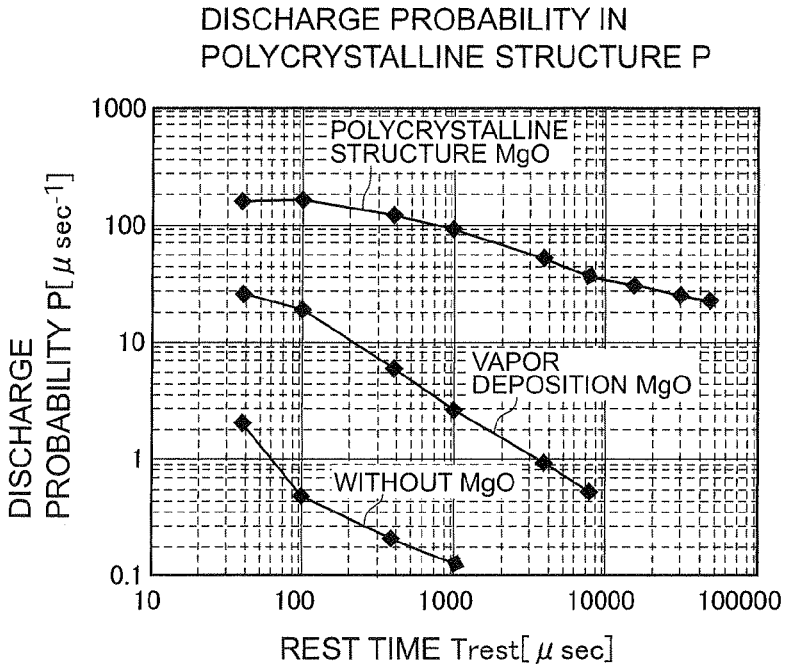
FIG. 11 is a graph showing the relationship between the discharge probability and a magnesium oxide single-crystal body of a polycrystalline structure.
FIG. 12 is a table showing the relationship between the discharge probability and the magnesium oxide single-crystal body of the polycrystalline structure.

FIG. 11 is a graph showing a comparison of the probability of a discharge (e.g., address discharge) occurring in discharge cells of the PDP with interposition of a magnesium oxide layer facing the discharge cells when the magnesium oxide layer is deposited by applying a coating of a paste including a vapor-phase MgO single-crystal body having an average particle diameter ranging from 2000 angstroms to 3000 angstroms, when the magnesium oxide layer is deposited by a conventional vapor deposition technique, and when a magnesium oxide layer is not provided. FIG. 12 shows the discharge probabilities when the discharge rest time is 1000 μsec in FIG. 11.

Figures 13, 14:
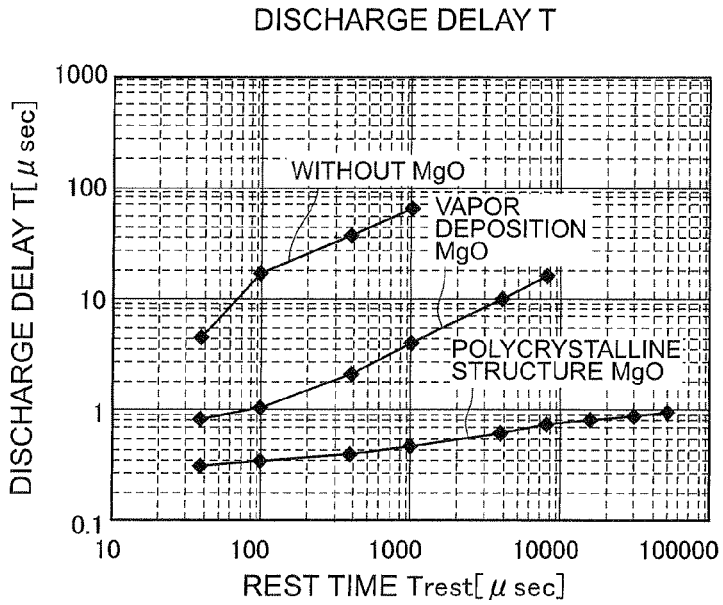
FIG. 13 is a graph showing the relationship between the discharge delay and the magnesium oxide single-crystal body of the polycrystalline structure.
FIG. 14 is a table showing the relationship between the discharge delay and the magnesium oxide single-crystal body of the polycrystalline structure.

Likewise, FIG. 13 is a graph showing a comparison of the discharge delay time between the case when a magnesium oxide layer disposed facing discharge cells of the PDP is deposited by applying a coating of a paste including a vapor-phase MgO single-crystal body having an average particle diameter ranging from 2000 angstroms to 3000 angstroms, the case when the magnesium oxide layer is deposited by a conventional vapor deposition technique, and the case when a magnesium oxide layer is not provided. FIG. 14 shows the discharge delay times when the discharge rest time is 1000 μsec in FIG. 13.

FIGS. 11 to 14 show the case when the magnesium oxide layer includes a vapor-phase MgO single-crystal body having a polycrystalline structure.

It is seen from FIGS. 11 to 14 that the vapor-phase MgO single-crystal body disposed in a position facing each discharge cell in the PDP is capable of contributing significantly to improvements in the discharge probability and the discharge delay of the PDP and also an improvement in discharge characteristics such as a reduction in the dependence of the discharge delay on the rest time and the like.

Figure 15:
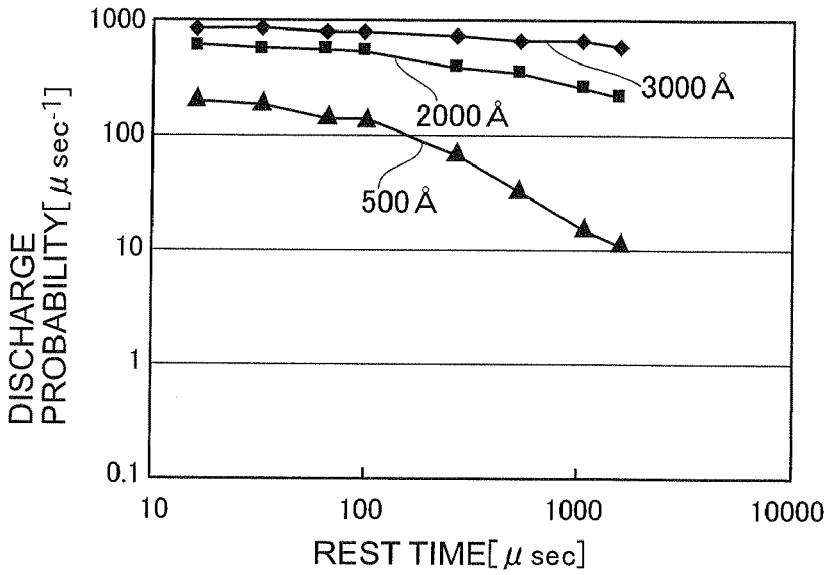
FIG. 15 is a graph showing the relationship between the discharge probability and the particle size of the magnesium oxide single-crystal body.

FIG. 15 is a graph showing the relationship between the discharge probability and the particle diameter of the vapor-phase MgO single-crystal body disposed facing the discharge cell.

It is seen from FIG. 15 that the larger the particle diameter of the vapor-phase MgO single-crystal body, the higher the PDP discharge probability, and the discharge probability is significantly enhanced because of the vapor-phase MgO single-crystal body that has a particle diameter (of 2000 angstroms and 3000 angstroms in the example shown in FIG. 15) causing the excitation of the CL emission with a peak of 235 nm as described above.

The estimated reason for the vapor-phase MgO single-crystal body causing a CL emission having a peak within a wavelength range from 200 nm to 300 nm (more specifically, from 230 nm to 250 nm, around 235 nm) to contribute to the improvement of the discharge characteristics of the PDP as described above is that the vapor-phase MgO single-crystal body has an energy level corresponding to the peak wavelength, so that the energy level enables the trapping of electrons for a long time (some msec. or more), and the trapped electrons are extracted by an electric field so as to serve as the primary electrons required for starting a discharge.

Also, because of the correlation between the intensity of the CL emission and the particle diameter of the vapor-phase MgO single-crystal body as described above (see FIG. 8), the stronger the intensity of the CL emission having a peak within the wavelength range of from 200 nm to 300 nm (more particularly, from 230 nm to 250 nm, around 235 nm), the greater the beneficial effect of improving the discharge characteristics caused by the vapor-phase MgO single-crystal body.

In other words, in order to produce a vapor-phase MgO single-crystal body with a large particle diameter, an increase in the heating temperature for generating magnesium steam is required. This requirement increases the length of the flame with which magnesium and oxygen react, in turn increasing the temperature difference between the flame and the surrounding ambience. Thus, the larger the particle diameter of the vapor-phase MgO single-crystal, the greater the number of energy levels occurring in correspondence with the peak wavelengths (e.g. within a range of from 230 nm to 250 nm, around 235 nm) of the CL emission as described earlier.

Also, as compared with a conventional vapor-phase oxidization technique, the energy levels corresponding to the peak wavelengths of the CL emission as described above are created in the vapor-phase MgO single-crystal body that is produced by increasing the amount of Mg evaporating per unit time to increase the region of the reaction between Mg and $O_2$ for a reaction with a greater amount of $O_2$.

It is estimated that in the case of a vapor-phase MgO single-crystal body of a cubic polycrystalline structure, many crystal-plane defects occur, and the presence of energy levels arising from these crystal-plane defects contributes to an improvement in discharge probability.

Next, a method for driving the PDP will be described.

The PDP is operated by use of a subfield method. The display period of a field is divided into a plurality of subfields. Each of the subfields includes a reset discharge period for producing a reset discharge for simultaneously initializing all the discharge cells, an address discharge period for producing an address discharge for selecting the discharge cells C from which the light emission occurs, and a sustain discharge period for producing a sustain discharge for causing the light emission for image generation.

For the reset discharge in the first reset discharge period in each subfield, the PDP initiates the opposing discharge between the row electrode Y and the column electrode D.

Figure 16:
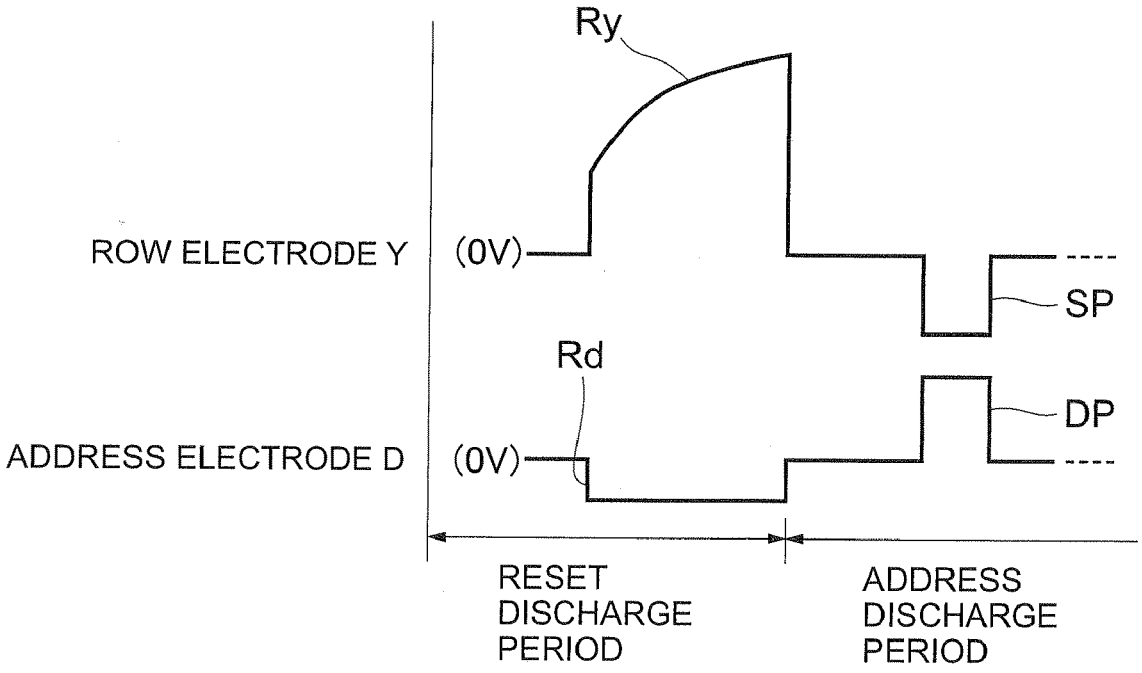
FIG. 16 is a pulse waveform diagram illustrating the form of a voltage pulse applied to a row electrode and a column electrode in the first embodiment.

FIG. 16 is a pulse waveform diagram showing voltage pulses applied to the row electrode Y and the column electrode D for the reset discharge.

In FIG. 16, a row-electrode reset pulse Ry of a positive polarity which has a gentle rise and a large time constant, rather than being a rectangular pulse, is applied to the row electrode Y. Simultaneously with the application of the row-electrode reset pulse Ry, a column-electrode reset pulse Rd of a negative polarity is applied to the column electrode D.

The application of the column-electrode reset negative pulse Rd and the row-electrode reset positive pulse Ry causes a discharge between the negative column electrode D and the positive row electrode Y in the direction from the row electrode Y toward the address electrode D (electrons flow from the column electrode D toward the row electrode Y) (the discharge initiated when the column electrode D is set as a negative electrode and the row electrode Y is set as a positive electrode is hereinafter referred to as "a negative column-electrode discharge").

In FIG. 16, SP indicates a scan pulse applied to the row electrodes Y in the address discharge period, and likewise DP indicates a data pulse applied selectively to the column electrodes D in the address discharge period. The address discharge is initiated between the row electrode Y to which the scan pulse SP is applied and the column electrode D to which the data pulse DP is applied.

For the reset discharge, the PDP produces the negative column-electrode discharge between the row electrode Y and the column electrode D which are on either side of the discharge cell C. As a result, in the reset discharge, positive ions in the discharge cell C generated from the discharge gas by the discharge travel toward the negative column electrode D, and then collide with the MgO crystal 7B serving as the secondary electron emission material mixed in the phosphor layer 7 close to the column electrode D, whereupon secondary electrons are emitted from the MgO crystal 7B into the discharge cell C.

Thus, the secondary electrons existing in the discharge cell C facilitate the initiation of the address discharge in the address discharge period following the reset discharge period, which in turn makes it possible to reduce the breakdown voltage for the address discharge.

At this point, the MgO crystal 7B is exposed from the surface of the phosphor layer 7, so that the positive ions effectively collide with the MgO crystal 7B, resulting in a further effective emission of the secondary electrons into the discharge cell C, leading to a reduction in the breakdown voltage for the subsequent address discharge.

In a typical PDP, the reset discharge also causes light emission. However, the light emission caused by the reset discharge has no relation to the gradation display of an image. For this reason, if the light emission caused by the reset discharge is observed on the panel screen, on which, particularly an image display with a zero level of luminance, and the like are generated, the dark contrast of the image is reduced. In contrast, for the reset discharge, the PDP according to the present invention produces the opposing discharge between the row electrode Y and the column electrode D. This opposing discharge occurs in a central portion of the discharge cell C distant from the panel screen (the surface of the front glass substrate 1). In consequence, the light emission caused by the reset discharge observed on the panel screen is decreased as compared with the reset discharge achieved by the surface discharge produced between the row electrodes in a position close to the panel screen, thus making it possible to improve the dark contrast of the displayed image.

Figure 17:
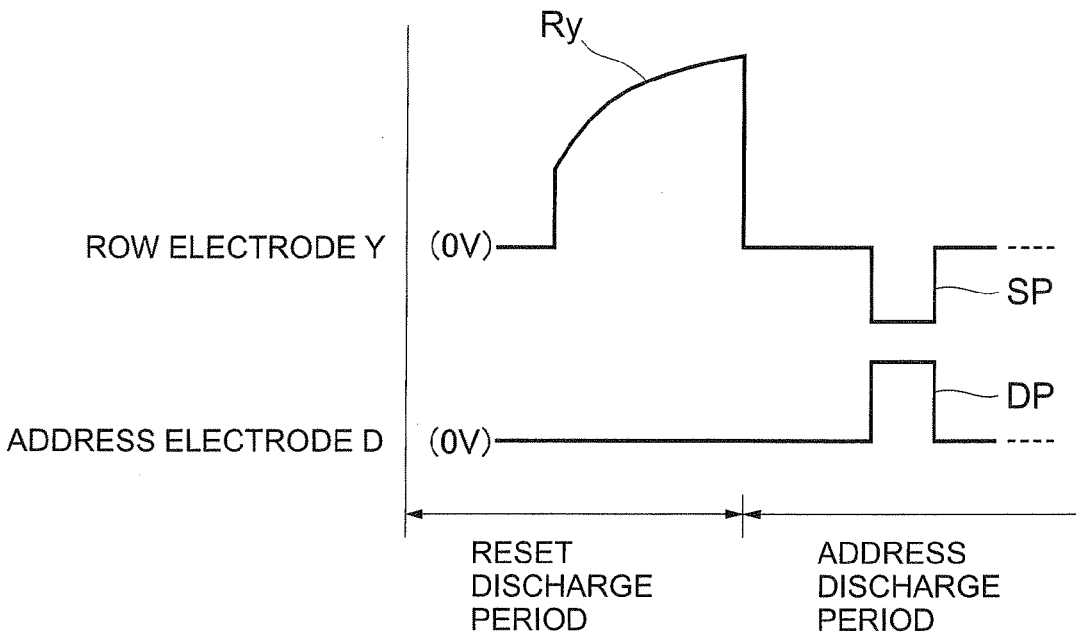
FIG. 17 is a pulse waveform diagram illustrating another example of the voltage pulse.

The foregoing has described the example (FIG. 16) of the application of the column-electrode reset pulse Rd of a negative polarity to the column electrode D. In order to initiate the reset discharge between the row electrode Y and the column electrode D when the row-electrode reset pulse Ry of a positive polarity is applied to the row electrode Y, the column electrode D should be set to a negative pole relative to the positive row electrode Y. For this purpose, for example, as shown in FIG. 17, the column electrode D may be set to the ground (GND) potential, or alternatively, a voltage pulse applied to the column electrode D may be of a positive polarity at a smaller potential than that of the row-electrode reset pulse Ry applied to the row electrode Y so as to allow initiation of the discharge between the row electrode Y and the column electrode D.

The following description is based on the assumption that the initiation of the negative column-electrode discharge as the reset discharge includes all the cases of setting the potential of the column electrode D to a negative pole relative to the row electrode Y, for example, the cases of setting the column electrode D at the ground (GND) potential and of applying a positive voltage pulse having a smaller potential than that of the row-electrode reset pulse Ry to the column electrode D.

Figure 18:
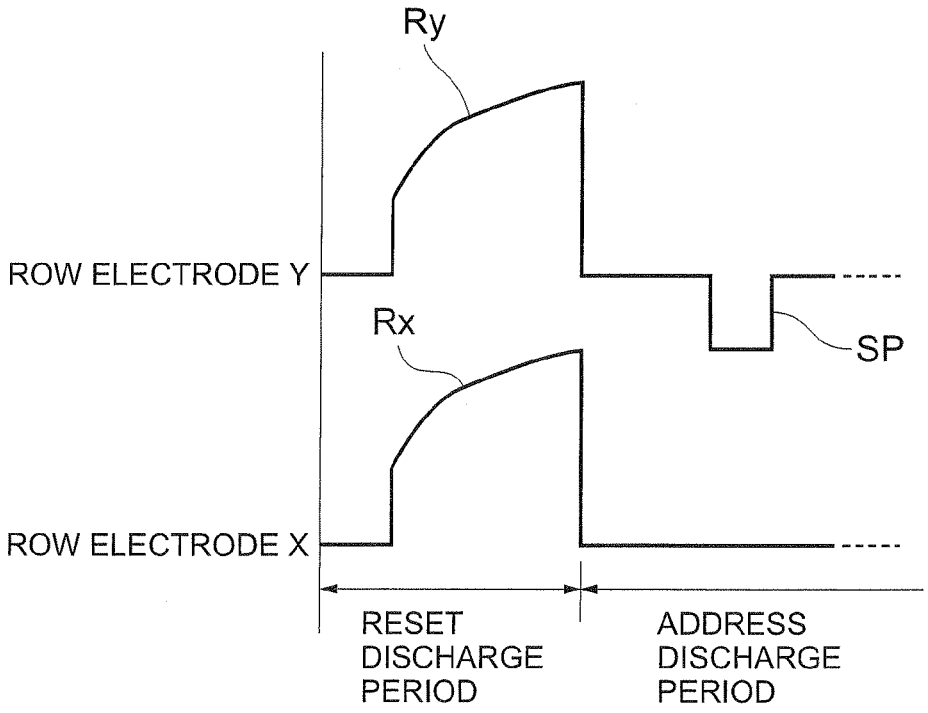
FIG. 18 is a pulse waveform diagram illustrating yet another example of the voltage pulse.

When the reset discharge is initiated, the row electrode X which together with the row electrode Y constitutes a row electrode pair may be maintained at the ground (GND) potential during the reset discharge period. In an alternative manner, as shown in FIG. 18, a voltage pulse Rx may be applied to the row electrode X and the voltage pulse Rx may be at the same potential as that of the row-electrode reset pulse Ry applied to the row electrode Y so as not to cause a potential difference that would initiate a discharge between the row electrodes X and Y.

As a result, during the occurrence of the reset discharge, a potential difference causing a discharge between the row electrodes X and Y constituting a row electrode pair is prevented, which thus makes it possible to reliably initiate only the opposing discharge between the row electrode Y and the column electrode D for the reset discharge, leading to a further improvement in dark contrast of the displayed image.

In the PDP of the present invention, when the MgO crystal 7B mixed in the phosphor layer 7 includes a CL-emission MgO crystal body having the property of causing a CL emission having a peak within a wavelength range of 200 nm to 300 nm upon excitation by electron beams as described earlier, as compared with the case when a phosphor layer is formed of a conventional MgO crystal not having the property of causing a CL emission (the MgO crystal not having the CL emission property is hereinafter referred to as a conventional MgO crystal), the properties of the CL-emission MgO crystal body as described with reference to FIGS. 7 to 15 shorten the discharge delay time. In addition, because the voltage pulse having a large time constant and a gentle rise is applied to the row electrode Y, the discharge intensity of the reset discharge which causes a reduction in dark contrast is decreased, thus significantly improving the dark contrast of the PDP.

In the PDP of the present invention, when the phosphor layer 7 is mixed with the MgO crystal 7B including the CL-emission MgO crystal body, the reset discharge results in the emission of initial electrons into the discharge cell C from the CL-emission MgO crystal body in the phosphor layer 7. The initial electrons cause a further reduction in the discharge delay in the reset discharge and an increase in the duration of the priming effect, resulting in the speeding up of the address discharge initiating subsequent to the reset discharge.

In the PDP of the present invention, as illustrated in FIG. 4, the CL-emission MgO crystal body mixed in the phosphor layer 7 is disposed in a portion of the surface of the phosphor layer 7 exposed to the inside of the discharge cell C. This design allows an effective emission of initial electrons from the CL-emission MgO crystal body into the discharge cell C without being obstructed by the phosphor particles in the phosphor layer 7, thus making it possible to further reduce the breakdown voltage for the address discharge.

Figure 19:
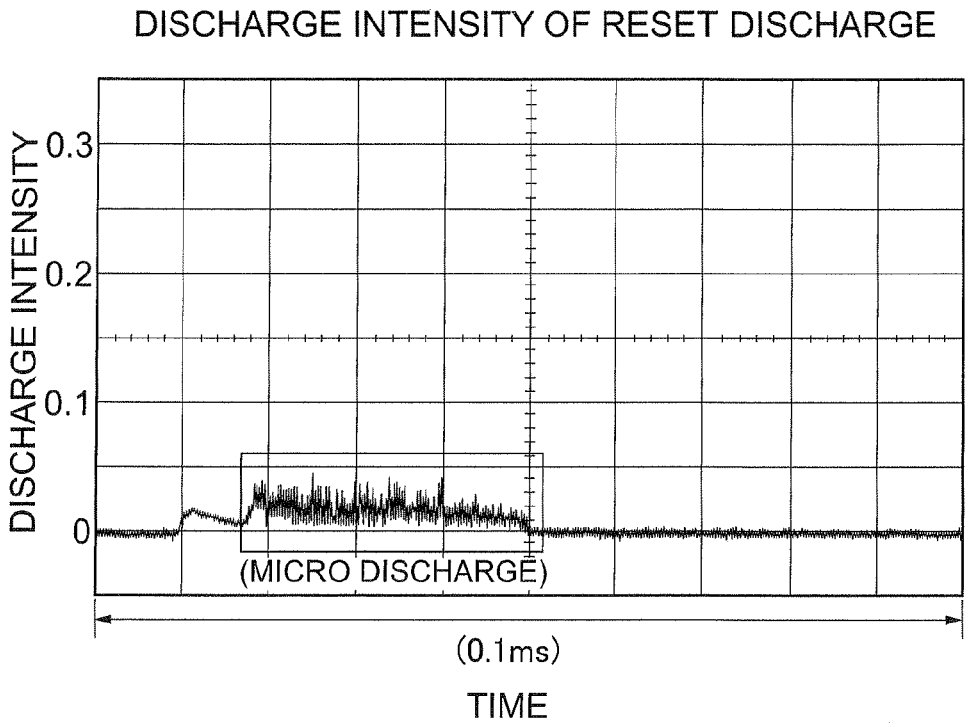
FIG. 19 is an oscilloscope waveform diagram showing the discharge intensity when a phosphor layer includes the CL-emission MgO crystal body in the first embodiment.
Figure 20:
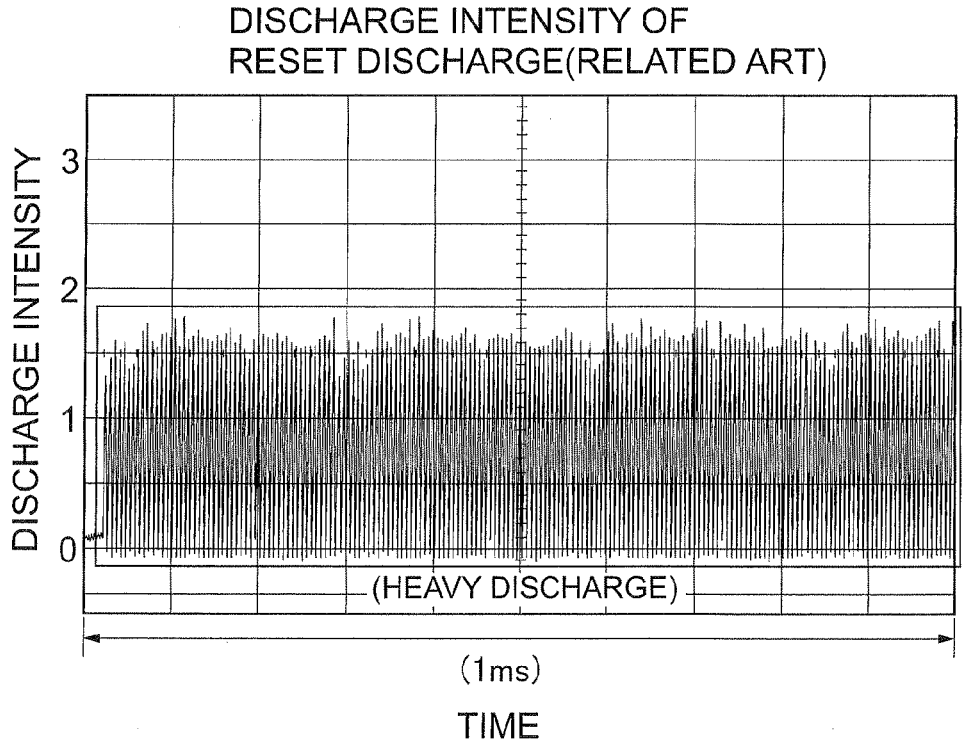
FIG. 20 is an oscilloscope waveform diagram showing the discharge intensity when the phosphor layer is formed of a phosphor material alone.

FIG. 19 is an oscilloscope waveform diagram showing the discharge intensity when the PDP provided with the phosphor layer 7 mixed with the MgO crystal 7B including the CL-emission MgO crystal body applies the voltage pulses of patterns as shown in FIG. 17 to the row electrode Y and the column electrode D to initiate the negative column-electrode discharge for the reset discharge. FIG. 20 is an oscilloscope waveform diagram showing the discharge intensity when a conventional PDP having a phosphor layer formed of a phosphor material alone applies the voltage pulse of patterns as shown in FIG. 17 to a row electrode and a column electrode to initiate a reset discharge.

With regard to the horizontal axis (time) in FIGS. 19 and 20, FIG. 20 shows 1 ms by 10 graduations on the scale, whereas FIG. 19 shows 0.1 ms by 10 graduations on the scale because the discharge intensity of the reset discharge is minute. That is, FIG. 19 indicates a scale 10 times shorter than that in FIG. 20. Likewise, the scale of the vertical axis (discharge intensity) in FIG. 19 is ten times weaker than that in FIG. 20.

FIG. 19 and FIG. 20 are compared. The discharge intensity of the reset discharge (negative column-electrode discharge) in FIG. 19 is significantly weaker than (from about one fortieth to about one fiftieth of) that in FIG. 20. The discharge time is within about 0.04 ms in FIG. 19, but in FIG. 20 the discharge intensity of the reset discharge is stronger and the discharge time is longer, 1 ms or more.

It is seen from this that the discharge intensity and the discharge delay are higher in FIG. 20, but the discharge intensity and the discharge delay are significantly decreased in FIG. 19, and that in the PDP illustrated in FIGS. 1 to 3 the mixing of the phosphor layer 7 with the CL-emission MgO crystal body included in the MgO crystal 7B provides a reduction in the discharge intensity and a reduction in the discharge delay time, which in turn achieves a considerable improvement in dark contrast.

The reason for the reduction of the discharge intensity in FIG. 19 may be the following. A CL-emission MgO crystal body that has the beneficial effect of improving the discharge delay as described above is mixed in the phosphor layer 7. Because of this mixing, the discharge time of the reset discharge is significantly shortened to within about 0.04 ms. When a voltage pulse having a larger time constant and a gentler rise as compared with the case of a rectangular pulse, as illustrated in FIGS. 16, 17, is applied to the row electrode Y, the reset discharge terminates in an early stage in the rise of the voltage pulse applied to the row electrode Y when the voltage value is small.

Figure 21:
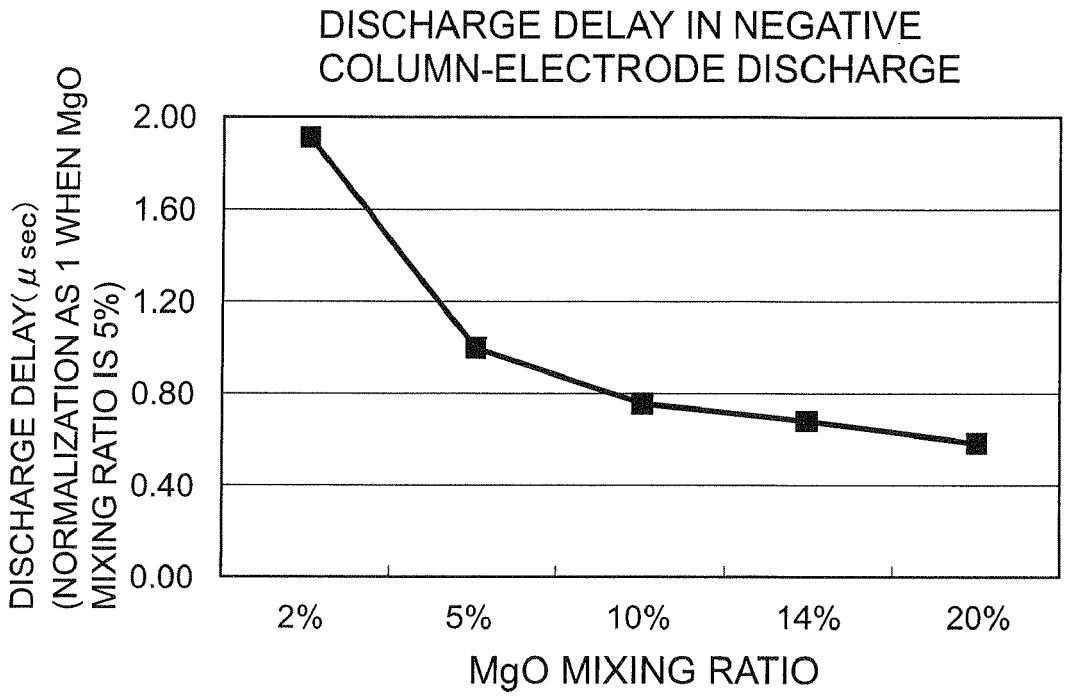
FIG. 21 is a graph showing the relationship between the discharge delay and a mixing ratio of the CL-emission MgO crystal body included in the phosphor layer in the first embodiment.

FIG. 21 shows the result of the measurement of the discharge delay time when, in the PDP provided with the phosphor layer 7 that includes the CL-emission MgO crystal body included in the MgO crystal 7B illustrated in FIGS. 1 to 3, a voltage pulse having a large time constant and a gentle rise is applied to the row electrode Y to initiate the negative column-electrode discharge.

The horizontal axis in FIG. 21 indicates the mixing ratio (percent by weight) of the MgO crystal including the CL-emission MgO crystal body to the phosphor material, and the vertical axis indicates the discharge delay time.

In this connection, the numerical values indicating the discharge delay on the vertical axis in FIG. 21 are the values obtained by the normalization as 1.0 of the discharge delay occurring when the mixing ratio of the MgO crystal is 5 percent.

It is seen from FIG. 21 that the greater the mixing ratio of the MgO crystal to the phosphor material in the phosphor layer 7, that is, the mixing ratio of CL-emission MgO crystal body, the shorter the discharge delay time of the negative column-electrode discharge, with the result that the CL-emission MgO crystal body has a beneficial effect on a reduction in the discharge delay time.

In this manner, it is seen from FIG. 19 that in the case when the PDP illustrated in FIGS. 1 to 3 is provided with the phosphor layer 7 that is mixed with the CL-emission MgO crystal body included in the MgO crystal 7B, and also applies the voltage pulse having a large time constant and a gentle rise to the row electrode Y, the discharge delay in the reset discharge is reduced and the discharge intensity is decreased, thus significantly improving the dark contrast of the PDP.

A similar measurement was carried out on a PDP provided with a phosphor layer mixed with only a conventional MgO crystal which does not include the CL-emission MgO crystal body in the state as illustrated in FIG. 4, and approximately the same results as in FIG. 20 were obtained. It is possible to achieve the advantageous effects of a reduced breakdown voltage and an improved dark contrast by means of the secondary electron emission as described earlier, but the improvement effects on the discharge delay and the discharge intensity are unable to be achieved.

The reason for this is estimated as follows. The conventional MgO crystal which is not the CL-emission MgO crystal body has a function of emitting the secondary electrons, but does not have an energy level corresponding to the peak wavelengths ranging from 230 nm to 250 nm as is created in the CL-emission MgO crystal body, so that the electrons cannot be trapped for a long time. In consequence, it is impossible to obtain a sufficient amount of initial electrons drawn into the discharge space upon the application of the voltage pulse.

By mixing the phosphor layer 7 with the MgO crystal 7B including the CL-emission MgO crystal body, the PDP according to the present invention has the advantageous effect of improving the brightness of the PDP as well as the advantageous effect of increasing the dark contrast as described above.

Specifically, in the sustain discharge period of a subfield, a sustain discharge, which is the surface discharge, is produced between the row electrodes X and Y constituting a row electrode pair in each of the discharge cells C which have been selected by the address discharge produced in the address discharge period antecedent to the sustain discharge period. The sustain discharge causes the emission of vacuum ultraviolet light of 146 nm and 172 nm from the xenon included in the discharge gas. The vacuum ultraviolet light excites the CL-emission MgO crystal body included in the phosphor layer 7 to cause a PL emission (photoluminescence emission). As a result, ultraviolet light having a peak at 230 nm to 250 nm (hereinafter referred to as "PL ultraviolet light") is generated.

Then, the PL ultraviolet light excites the phosphor material 7A included in the phosphor layer 7. For this reason, as compared with the case of mixing a phosphor layer with a conventional MgO crystal alone, the PDP according to the present invention is improved in luminance.

The following is the reasons why the advantageous effects of improving the brightness of the PDP as described above are produced in the use of the phosphor layer 7 mixed with the CL-emission MgO crystal body included in the MgO crystal 7B.

Typically, an MgO crystal has the property of absorbing vacuum ultraviolet light emitted from the xenon included in the discharge gas by a discharge without allowing it to pass therethrough. For this reason, for example, when a phosphor layer is mixed with a conventional MgO crystal alone which is not the CL-emission MgO crystal body, the MgO crystal absorbs the vacuum ultraviolet light emitted from the xenon in the discharge gas. As a result, the amount of ultraviolet light applied to the phosphor particles around the MgO crystal is reduced, resulting in a reduction in the brightness of the PDP as compared with a PDP having a phosphor layer 7 formed of a phosphor material alone.

However, when the CL-emission MgO crystal body included in the MgO crystal 7B is mixed in the phosphor layer 7, the CL-emission MgO crystal body absorbs the vacuum ultraviolet light emitted from the xenon in the discharge gas, and then is excited by the vacuum ultraviolet light to cause a PL emission, resulting in the emission of PL ultraviolet light having a peak wavelength ranging from 230 nm to 250 nm.

The PL ultraviolet light excites the phosphor material 7A in the phosphor layer 7 to allow it to emit visible light. Thus, there is no possibility of a reduction in luminance which is produced by mixing the phosphor layer 7 with the conventional MgO crystal alone. The phosphor material 7A of the phosphor layer 7 is excited by the PL ultraviolet light emitted from the CL-emission MgO crystal body as well as by the vacuum ultraviolet light emitted from the xenon in the discharge gas. In consequence, the amount of visible light emitted from the phosphor layer 7 significantly increase the brightness of the PDP as compared with the case when the MgO crystal 7B mixed in the phosphor layer comprises the conventional MgO crystal alone, other than the CL-emission MgO crystal body.

In addition, since the CL-emission MgO crystal body is mixed, together with the phosphor material 7A, in the phosphor layer 7 so as to be located immediately close to the phosphor particles, the PL ultraviolet light emitted from the CL-emission MgO crystal body is effectively applied to the phosphor material 7A, thus further increasing the luminance of the PDP.

Figure 22:
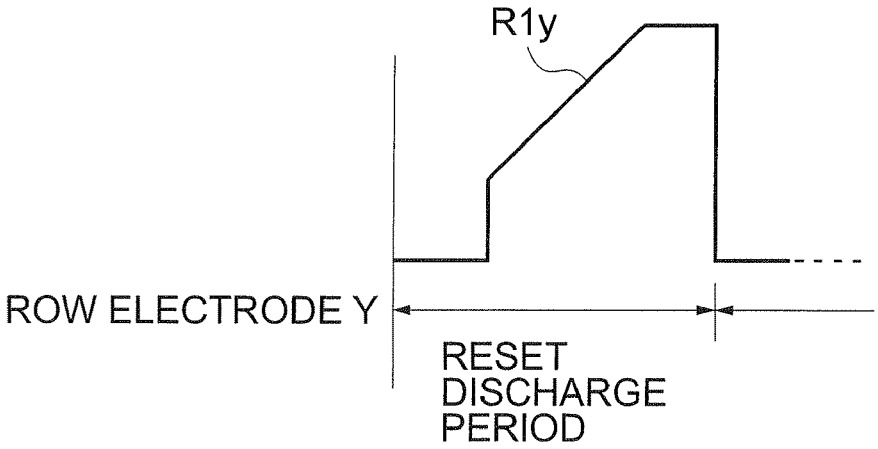
FIG. 22 is a pulse waveform diagram showing another form of the voltage pulse applied to the row electrode in the first embodiment.

The foregoing has described the example of the row-electrode reset pulse applied to the row electrode Y for the reset discharge when it has a waveform in which a voltage pulse rises smoothly while changing in the gradient of the rise as shown in FIGS. 16 and 17. In an alternative manner, the row-electrode reset pulse may be a voltage pulse R1*y* linearly rising at a constant gradient as shown in FIG. 22.

In this case, it is also possible to achieve approximately the same beneficial effect of improving the dark contrast as that when the row-electrode reset pulse has the waveform illustrated in FIGS. 16 and 17.

Figure 23:
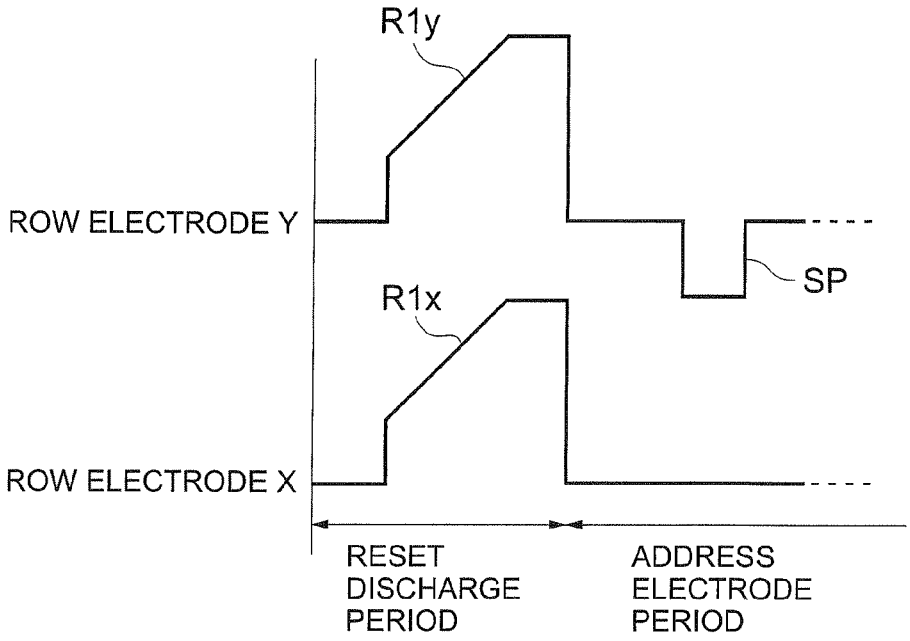
FIG. 23 is a pulse waveform diagram showing another example of the voltage pulse.

Then, when a voltage pulse is applied to one row electrode X of a row electrode pair concurrently with the application of the row-electrode reset pulse to the other row electrode Y of the row electrode pair as in the case of FIG. 18, the row electrode X may preferably receive a voltage pulse R1*x* having the same waveform and the same polarity as those of the row-electrode reset pulse R1*y* applied to the row electrode Y as illustrated in FIG. 23.

This makes it possible to reliably initiate a reset discharge only between the row electrode Y and the column electrode D.

The foregoing has described the example of the structure in which the reset discharge is produced between the row electrode Y and the column electrode D. The PDP may be structured to apply the row-electrode reset pulse to the row electrode X such that the reset discharge is initiated between the row electrode X and the column electrode D.

Next, a description will be given of the relationship between the electrification property of the phosphor layer and the amount of the CL-emission MgO crystal body mixed in each of the red, green and blue phosphor layers 7(R), 7(G), 7(B).

Figure 24:
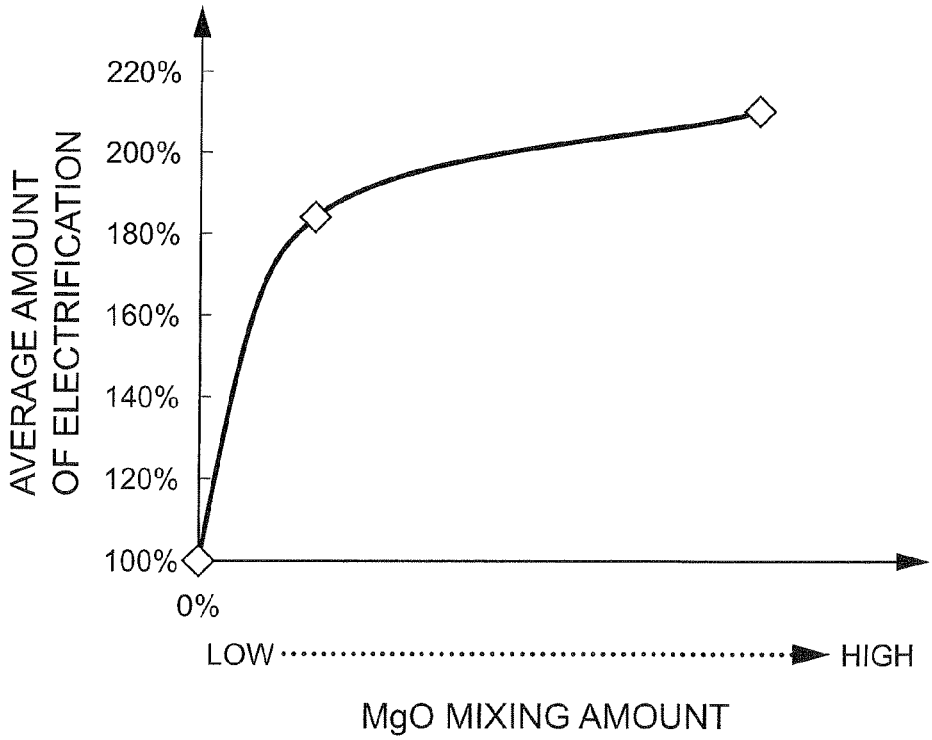
FIG. 24 is a graph showing the relationship between the amount of CL-emission MgO crystal body mixed into the phosphor layer and the average charge amount of the phosphor layer.

FIG. 24 is a graph showing the relationship between the mixing amount of the CL-emission MgO crystal body and the average electrification property of the phosphor layer when the phosphor layer 7 is mixed with the CL-emission MgO crystal body as the secondary electron emission material.

As is seen from FIG. 24, with an increase of the mixing amount of the CL-emission MgO crystal body in the phosphor layer, the average amount of the electrification of the phosphor layer increases.

In the PDP, an increase in the average amount of the electrification of the phosphor layer triggers a drop in the discharge voltage.

In FIG. 24, the origin of the vertical axis shows zero percent of the mixing amount of the CL-emission MgO crystal body in the phosphor layer, and the origin of the horizontal axis shows 100 percent of the average amount of the electrification.

The PDP according to the present invention is capable of achieving a reduction in discharge delay and an increase in discharge probability as described above by mixing the CL-emission MgO crystal body in each of the red, green and blue phosphor layers 7(R), 7(G), 7(B) as well as by providing the magnesium oxide layer 3 including the CL-emission MgO crystal body.

However, if the amount of the CL-emission MgO crystal body mixed in the phosphor layer is equal among the red, green and blue phosphor layers, the green phosphor material forming part of the green phosphor layer, e.g., $Zn_{2-x}SiO_4$:$Mn_x$, has a lower electrification level than those of the red phosphor material forming part of the red phosphor layer and of the blue phosphor material forming part of the blue phosphor layer, and thus has the anti-surface-electrification properties. A difference between the electrification properties of the red, green and blue phosphor materials of the phosphor layers when a discharge is initiated gives rise to a slight time difference among the discharges occurring in the respective red, green and blue discharge cells.

Specifically, the discharge voltage required for initiating a discharge in the green discharge cell in which the green phosphor layer is formed is higher than those in the red discharge cell and the blue discharge cell. Accordingly, the discharge in the green discharge cell occurs slightly later than the discharge in the red and blue discharge cells. For this delay, even if the sustain discharge is initiated simultaneously in the red, green and blue discharge cells for a white display, the discharge intensity in the green discharge cell is reduced due to the time difference in discharge occurrence in the red, green and blue discharge cells, resulting in a magenta display instead of a white display.

In addition, the variations in discharge voltage in the red, green and blue discharge cells cause a reduction in discharge-voltage margin.

For overcoming those disadvantages, the PDP according to the present invention takes advantage of the relationship between the mixing amount of the CL-emission MgO crystal body and the electrification amount of the phosphor layer as shown in FIG. 24. That is, a larger amount of the CL-emission MgO crystal body 7B which is the secondary electron emission material is mixed in the green phosphor layer 7(G) than those mixed in the red phosphor layer 7(R) and the blue phosphor layer 7(B).

The amount of the CL-emission MgO crystal body 7B mixed in the green phosphor layer 7(G) is determined such that the electrification amount of the green phosphor layer 7(G) becomes approximately equal to those of the red phosphor layer 7(R) and the blue phosphor layer 7(B).

By adjusting the mixing amount of the CL-emission MgO crystal body, the rate of reduction in the discharge voltage in the green discharge cell C(G) becomes relatively larger than those in the discharge voltage in the red discharge cell C(R) and the blue discharge cell C(B). Because of this, the discharge-voltage margin is increased and a clear white display is achieved.

The foregoing has described the case when the same amount of the CL-emission MgO crystal body 7B is mixed in each of the red and blue phosphor layers 7(R), 7(B). In an alternative manner, different amounts of the CL-emission MgO crystal body to be mixed in the red phosphor layer 7(R) and the blue phosphor layer 7(B) may be respectively determined in accordance with the electrification properties of the red phosphor material 7(R)A and the blue phosphor material 7(B)A.

In this manner, the amounts of the CL-emission MgO crystal body mixed in the red, green and blue phosphor layers 7(R), 7(G), 7(B) are respectively determined in accordance with the electrification properties of the red, green and blue phosphor materials 7(R)A, 7(G)A, 7(B)A. This determination makes it possible to reduce the variations of the discharge voltages in the red, green and blue discharge cells C(R), C(G), C(B). In turn, the discharge-voltage margin is increased and a clearer white display is achieved.

As described above, by mixing the CL-emission MgO crystal body 7B in the phosphor layers 7(R), 7(G), 7(B) such that the CL-emission MgO crystal body 7B is exposed to the respective discharge cells C(R), C(G), C(B), the PDP according to the present invention is able to achieve a reduction in the discharge delay and an increase in the discharge probability as compared with the case of the conventional PDP, and to achieve a significant improvement in dark contrast, and also to prevent a time difference in discharge occurrence from being produced between the red, green and blue discharge cells C(R), C(G), C(B) so as to increase the discharge-voltage margin and produce a clear white display.

Second Embodiment

Figure 25:
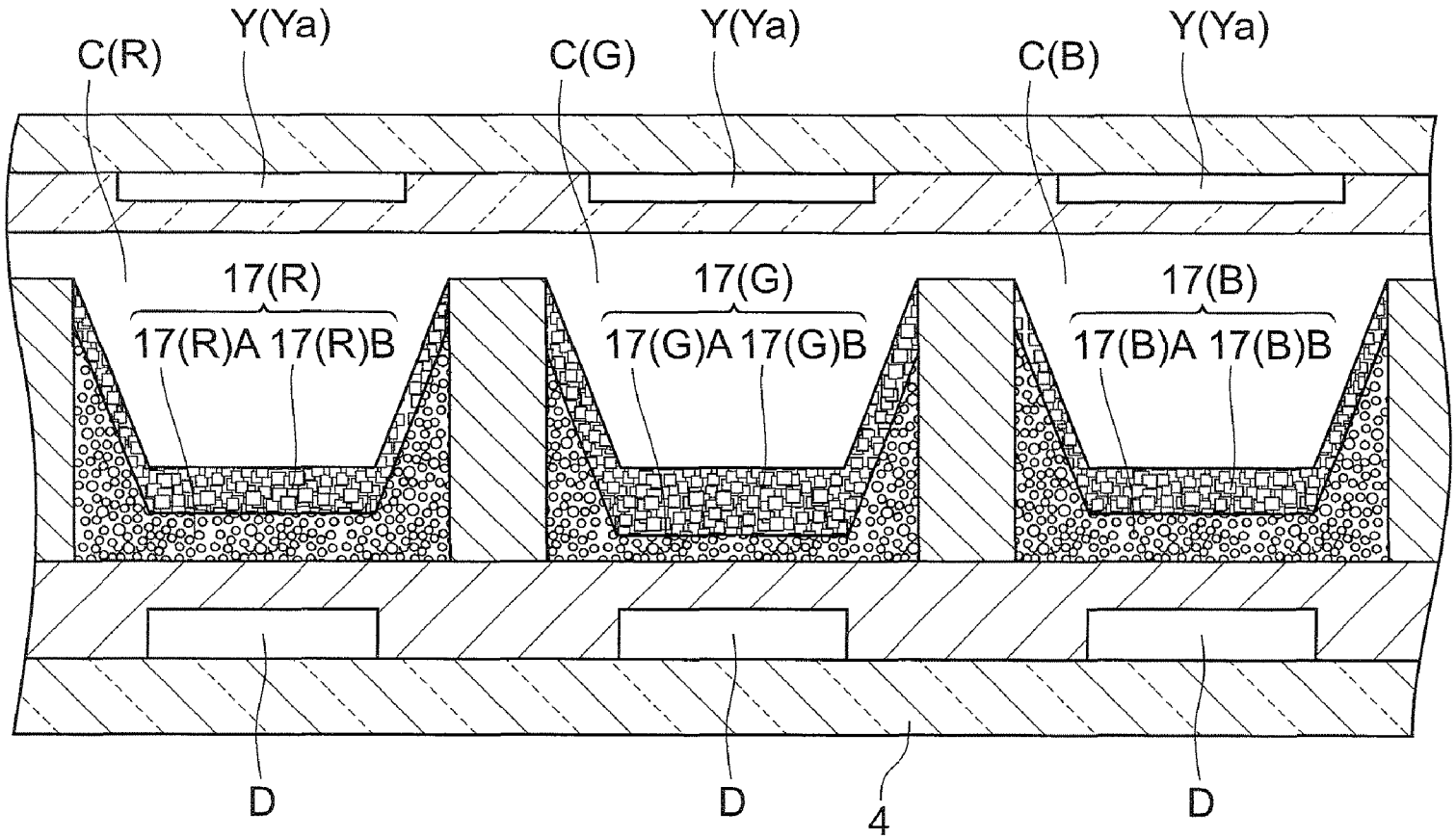
FIG. 25 is a sectional view illustrating an example of a second embodiment according to the present invention.

FIG. 25 is a sectional view illustrating a second embodiment of the PDP according to the present invention.

The phosphor layer of the PDP described in the first embodiment is formed of a mixture of the phosphor material and the MgO crystal which is the secondary electron emission material. In the PDP of this second embodiment, a red phosphor layer 17(R), a green phosphor layer 17(G) and a blue phosphor layer 17(B) are respectively composed of a red phosphor material layer 17(R)A, a green phosphor material layer 17(G)A and a blue phosphor material layer 17(B)A which are respectively formed of red, green and blue phosphor materials, and MgO crystal layers 17(R)B, 17(G) B, 17(B)B which are respectively formed of MgO crystal which is the secondary electron emission material and are stacked on the respective red, green and blue phosphor material layers 17(R)A, 17(G)A, 17(B)A. The MgO crystal layers 17(R)B, 17(G)B, 17(B)B are exposed to the inside of the corresponding discharge cells C(R), C(G), C(B).

The MgO crystal layers 17(R)B, 17(G) B, 17(B)B may be formed in such a manner as to spread the MgO crystals all over each of the phosphor material layers 17(R)A, 17(G)A, 17(B)A. In a further alternative manner, a thin film formed of the MgO crystal may be deposited on each of the red, green and blue phosphor material layers 17(R)A, 17(G)A, 17(B)A.

If the CL-emission MgO crystal body is included as the secondary electron emission material forming the MgO crystal layers 17(R)B, 17(G)B, 17(B)B, the MgO crystal layers 17(R)B, 17(G)B, 17(B)B are formed in such a manner as to spread the CL-emission MgO crystal body all over each of the phosphor material layers 17(R)A, 17(G)A, 17(B)A.

The thickness of the MgO crystal layer 17(G)B stacked on the green phosphor material layer 17(G)A of the green phosphor layer 17(G) is greater than the thickness of each of the MgO crystal layers 17(R)B, 17(B)B respectively forming parts of the red and blue phosphor layers 17(R), 17(B).

The thickness of the MgO crystal layer 17(G) B forming part of the green phosphor layer 17(G) is determined such that the electrification amount of the green phosphor layer 17(G) becomes approximately equal to those of the red phosphor layer 17(R) and the blue phosphor layer 17(B).

The MgO crystal layers 17(R)B, 17(B)B respectively forming parts of the red phosphor layer 17(R) and the blue phosphor layer 17(B) may be equal in thickness to each other, or instead, may be formed with different thicknesses respectively determined in accordance with the electrification properties of the respective phosphor material layers 17(R)A, 17(B)A.

The structure of other components of the PDP is approximately the same as that in the first embodiment, and the same structure is indicated with the same reference numerals as those in the first embodiment.

The PDP is operated by the same method as that in the first embodiment.

Specifically, for the initiation of the reset discharge, a row-electrode reset pulse with a waveform as shown in FIG. 16 or 22 is applied to the row electrode Y to produce an opposing discharge as a negative column-electrode discharge between the column electrode D and the row electrode Y.

Because the red, green and blue phosphor layers 17(R), 17(G), 17(B) of the PDP of the second embodiment are respectively provided with the MgO crystal layers 17(R)B, 17(G)B, 17(B)B respectively exposed to the insides of the red, green and blue discharge cells C(R), C(G), C(B), the PDP is able to achieve a reduction in the discharge delay and an increase in the discharge probability as compared with the case of the conventional PDP, and to achieve a significant improvement in dark contrast. Also, the thicknesses of the MgO crystal layers 17(R)B, 17(G) B, 17(B)B are respectively determined in accordance with the electrification properties of the red, green and blue phosphor material layers 17(R)A, 17(G)A, 17(B)A. In consequence, the PDP is able to reduce the variations in discharge voltage in the red, green and blue discharge cells C(R), C(G), C(B), resulting in an increase in the discharge-voltage margin and a clearer white display.

Third Embodiment

Next, a third embodiment of the PDP according to the present invention will be described.

In the example of each of the first and second embodiment, the green phosphor layer includes a larger amount of the secondary electron emission material than those in the red phosphor layer and the blue phosphor layer in order to produce a clearer white display. The PDP in the third embodiment has the structure of the red, green and blue phosphor layers for improving the white display, and additionally, the structure for preventing the black level luminance from decreasing because of the phosphor layer mixed with the secondary electron emission material.

The third embodiment is applicable to both the PDP of the first embodiment in FIG. 4 and the PDP of the second embodiment in FIG. 25, but the following description is the case when the third embodiment is applied to the PDP in FIG. 4.

In FIG. 4, the MgO crystal 7B as the secondary electron emission material is mixed in each of the green, red, and blue phosphor layers 7(G), 7(R), 7(B). As described in the first embodiment, the MgO crystal 7B includes magnesium oxide including MgO crystal body having properties of causing a cathode-luminescent emission having a wavelength peak ranging from 200 nm to 300 nm upon excitation by electron beams.

A larger amount of the MgO crystal 7B is mixed in the green phosphor layer 7(G) than that mixed in each of the red and blue phosphor layers 7(R), 7(B).

The reason why the MgO crystal 7B as the secondary electron emission material is mixed in each of the green, red and blue phosphor layers 7(G), 7(R), 7(B) is for the purposes of emitting, in the opposing discharge through each phosphor layer, secondary electrons as priming particles from the MgO crystal 7B into the discharge cell C, to reduce the breakdown voltage for the discharge subsequent to the opposing discharge in the discharge cell.

The following is the reason why the amount of the MgO crystal 7B mixed in the green phosphor layer 7(G) is greater than those mixed in the red phosphor layer 7(R) and the blue phosphor layer 7(B). The electrification amount of the green phosphor material forming part of the green phosphor layer 7(G) is relatively lower than those of the red phosphor material forming part of the red phosphor layer 7(R) and the blue phosphor material forming part of the blue phosphor layer 7(B). If the same amount of the MgO crystal 7B is mixed in each of the red, green and blue phosphor layers, this makes the breakdown voltage for the opposing discharge in the discharge cell C in which the green phosphor layer 7(G) is formed increase relative to those in the discharge cells C in which the red phosphor layer 7(R) and the blue phosphor layer 7(B) are formed, resulting in a time difference in discharge occurrence.

In this connection, if an excessive amount of the MgO crystal 7B is mixed in the green phosphor layer 7(G) with respect to the amount of the MgO crystal 7B mixed in each of the red and blue phosphor layers 7(R), 7(B), the follow disadvantages will arise.

When the opposing discharge is initiated between the row electrode Y and the column electrode D (see FIG. 4), voltage pulses of one size are applied to the row electrodes Y and the column electrodes D facing the corresponding discharge cells C in which the red phosphor layer 7(R), the green phosphor layer 7(G) and the blue phosphor layer 7(B) are respectively provided.

Accordingly, if the content of the MgO crystal 7B in the green phosphor layer 7(G) to such an extent that the breakdown voltage in the discharge cell C in which the green phosphor layer 7(G) is provided decreases below the breakdown voltage in the discharge cells C in which the red phosphor layer 7(R) and the blue phosphor layer 7(B), when the voltage pulses are applied to the row electrode Y and the column electrode D for the initiation of the opposing discharge, the opposing discharge occurs first in the discharge cell C in which the green phosphor layer 7(G) is provided and the breakdown voltage is lowest, resulting in the largest amount of light emitted from the discharge cell C in which the green phosphor layer 7(G) is provided.

Typically, the human visual sensitivity to green light emission is higher. For this reason, among the discharge cells in which the opposing discharge is initiated, the opposing discharge occurs earliest in the discharge cell C in which the green phosphor layer 7(G) is provided as described above and from which the amount of light emitted is largest. In this case, for example, when the opposing discharge is generated between the row electrode Y and the column electrode D to produce the reset discharge for the initialization of all the discharge cells C, the viewer senses high black-level luminance on the PDP screen at the time of initiating the reset discharge, resulting in a reduction in dark contrast.

The third embodiment is intended to overcome the problems arising when the MgO crystal 7B is mixed in each of the red, green and blue phosphor layers 7(R), 7(G), 7(B) in order to reduce the breakdown voltage for the opposing discharge in each discharge cell C as described above.

Specifically, in the third embodiment, the amount of the MgO crystal 7B mixed in the green phosphor layer 7(G) is determined to be larger than the amount of the MgO crystal 7B mixed in the red phosphor layer 7(R) and the blue phosphor layer 7(B). In addition, the amount of the MgO crystal 7B mixed in each of the red, green and blue phosphor layers is determined such that the breakdown voltage V(R) for the opposing discharge in the discharge cell C in which the red phosphor layer 7(R) is provided, the breakdown voltage V(G) for the opposing discharge in the discharge cell C in which the green phosphor layer 7(G) is provided, and the breakdown voltage V(B) for the opposing discharge in the discharge cell C in which the blue phosphor layer 7(B) is provided, maintain the relationship $$V(G) \geqq V(R) \geqq V(B),$$

within the range that the breakdown voltages V(G), V(R), V(B) are considered to be approximately equal to each other.

Figure 26:
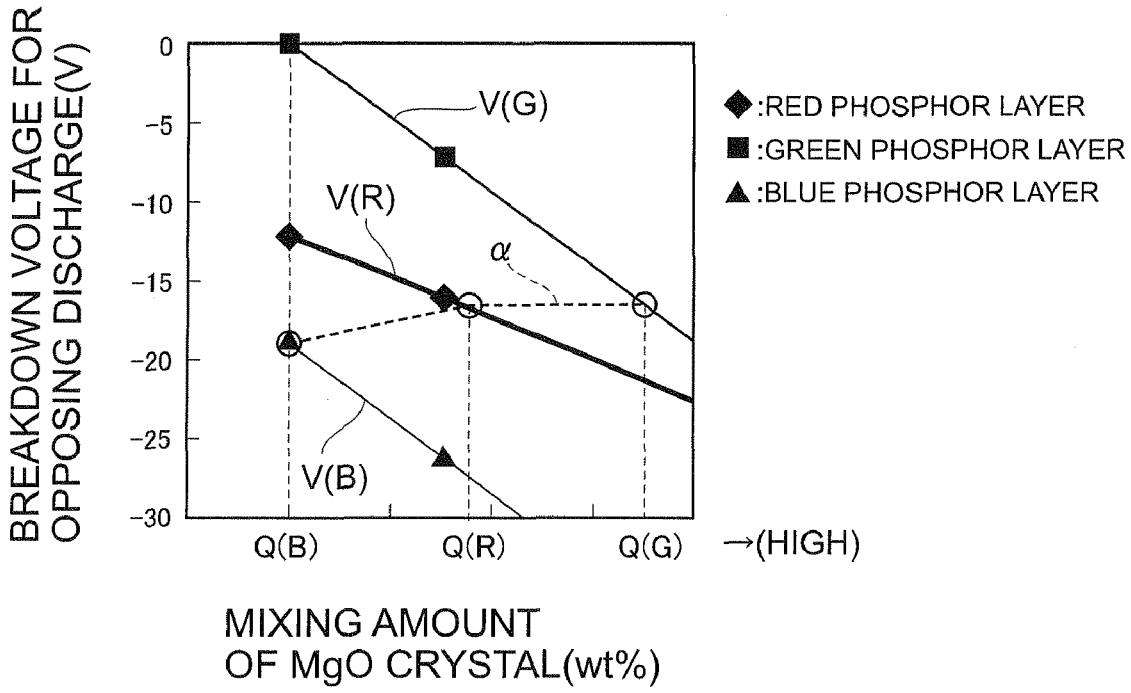
FIG. 26 is a graph showing an example of the setting of the amount of mixed secondary electron emission material in an example of a third embodiment according to the present invention.

FIG. 26 is a graph showing the relationship between the mixing amount of the MgO crystal 7B in each of the red, green and blue phosphor layers 7(R), 7(G), 7(B), and the breakdown voltages V(R), V(G), V(B) for the opposing discharge in the discharge cells in which the red, green and blue phosphor layers 7(R), 7(G), 7(B) are respectively provided.

In FIG. 26, the vertical axis shows the values of the breakdown voltage for the opposing discharge through the phosphor layer, and the horizontal axis shows the mixing amount of the MgO crystal 7B in the phosphor layer which is expressed in percent by weight of the phosphor forming part of the phosphor layer with respect to the value obtained when the breakdown voltage V(G) for the opposing discharge in the discharge cell C in which the green phosphor layer 7(G) is provided reaches zero V.

In FIG. 26, when the amount of MgO crystal 7B which makes breakdown voltage V(G) reach zero V is mixed in each of the red and blue phosphor layers 7(R), 7(B), the breakdown voltage V(R) for the opposing discharge in the discharge cell C in which the red phosphor layer 7(R) is provided is 12 V lower than the breakdown voltage V(G), and the breakdown voltage V(B) for the opposing discharge in the discharge cell C in which the blue phosphor layer 7(B) is provided is 19 V lower than the breakdown voltage V(G).

Each of the breakdown voltages V(R), V(G), V(B) reduces with an increase in the mixing amount of the MgO crystal 7B in the corresponding phosphor layer.

In FIG. 26, the amount Q(R) of the MgO crystal 7B mixed in the red phosphor layer 7(R), the amount Q(G) of the MgO crystal 7B mixed in the green phosphor layer 7(G), and the amount Q(B) of the MgO crystal 7B mixed in the blue phosphor layer 7(B) can be respectively calculated from, for example, the values on the broken line α in FIG. 26 at which the breakdown voltages V(R), V(G), V(B) satisfy the requirements of V(G)≧V(R)≧V(B) as described above.

Typically, the human visual sensitivity to light emission from the blue phosphor layer 7(B) is minimum and the human visual sensitivity to light emission from the green phosphor layer 7(G) is maximum.

For this reason, in the PDP according to the third embodiment, the mixing amount Q(R), Q(G), Q(B) of the MgO crystal 7B in the red phosphor layer 7(R), the green phosphor layer 7(G) and the blue phosphor layer 7(B) are determined such that the breakdown voltages V(R), V(G), V(B) for the opposing discharge through the phosphor layers in the discharge cells C in which the red, green and blue phosphor layers are respectively provided satisfy the requirement of V(G)≧V(R)≧V (B) within the range that the breakdown voltages V(G), V(R), V(B) are considered to be approximately equal to each other. Because of this determination, even when a larger amount of the MgO crystal 7B is mixed in the green phosphor layer 7(G) than that mixed in the red phosphor layer 7(R) and the blue phosphor layer 7(B), it is possible to prevent the viewer from sensing high black-level luminance at the time of the initiation of opposing discharge, such as the reset discharge, occurring through the phosphor layer, resulting in the prevention of a reduction in dark contrast.

In a basic idea of the PDP described in the aforementioned embodiments, a PDP comprises a pair of substrates placed across a discharge space, a plurality of row electrode pairs provided on one of the pair of substrates, a plurality of column electrodes provided on the other substrate and extending in a direction at right angles to the row electrode pairs to form unit light emission areas in the discharge space respectively corresponding to the intersections with the row electrode pairs, and phosphor layers of red, green and blue colors provided in respective positions facing the respective unit light emission areas between the column electrodes and the row electrode pairs, each of the red phosphor layers being formed of a red phosphor material and making a red unit light mission area of the corresponding unit light emission area, each of the green phosphor layers being formed of a green phosphor material and making a green unit light emission area of the corresponding unit light emission area, and each of the blue phosphor layers being formed of a blue phosphor material and making a blue unit light emission area of the corresponding unit light emission area, wherein each of the phosphor layers includes a secondary electron emission material, the secondary electron emission material is magnesium oxide including a magnesium oxide crystal body having properties of causing a cathode-luminescence emission having a peak within a wavelength range of 200 nm to 300 nm upon excitation by electron beams, and the phosphor layer of a required color of the red, green and blue phosphor layers includes a different amount of the secondary electron emission material than the phosphor layers of the remaining colors. According to a best mode of a method for operating the PDP described in the embodiments of the present invention, the method of operating the PDP comprises the step of, in the PDP, applying a voltage pulse to one row electrode of each of the row electrode pairs and setting the potential of the corresponding column electrode to be negative relative to the row electrode to which the voltage pulse is applied to initiate an opposing discharge between the column electrode and the row electrode.

In the PDP according to the present invention, the phosphor layer placed facing the unit light emission area includes a secondary electron emission material, and an opposing discharge is initiated between one row electrode of each row electrode pair and the column electrode which are positioned on either side of the phosphor layer. Because of this design, upon the discharge occurrence, positive ions generated from the discharge gas in the unit light emission area collide with the secondary electron emission material included in the phosphor layer, whereupon secondary electrons are emitted from the secondary electron emission material into the unit light emission area.

Thus, the secondary electrons existing in the unit light emission area facilitate occurrence of a discharge initiated subsequent to the opposing discharge between the row electrode and the column electrode, resulting in a reduction for the breakdown voltage for the discharge.

In the case when the opposing discharge produced between the row electrode and the column electrode is a reset discharge for initializing all the unit light emission areas in the operation of the PDP, the opposing discharge occurs approximately in a central portion of the unit light emission area distant from the substrate of the pair of substrates which constitutes the panel screen of the PDP. For this reason, as compared with the case when the reset discharge is provided by a surface discharge initiated between the row electrodes in a position close to the panel screen, the amount of light emission caused by the reset discharge and observed on the panel screen is reduced. In consequence, the dark contrast is prevented from being reduced by the light emission caused by the reset discharge and unrelated to gradation display of an image, leading to an improvement in dark contrast of the PDP.

In addition, for the phosphor layer of the PDP according to the present invention, the red phosphor layer, the green phosphor layer and the blue phosphor layer respectively include different amounts of the secondary electron emission material determined in accordance with the electrification properties of the phosphor materials respectively used for forming the red, green and blue phosphor layers, such that the amounts of electrification of the red, green and blue phosphor layers are adjusted to be approximately equal to each other. Because of this adjustment, the discharge voltages in the red, green and blue unit light emission areas become approximately equal to each other so as to start the discharge approximately at the same time. In consequence, an increase in discharge voltage margin is achieved, thus achieving clearer white display.

In the method of operating the PDP according to the present invention, the opposing discharge between one row electrode of each row electrode pair and the column electrode is produced by applying a voltage pulse to the row electrode and setting the potential of the column electrode to a negative potential relative to the row electrode receiving the voltage pulse. By the opposing discharge, the positive ions are produced from the discharge gas. The positive ions travel toward the negative column electrode and collide with the secondary electron emission material included in the phosphor layer. Because of this collision, secondary electrons are effectively emitted into the unit light emission area from the secondary electron emission material.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel, comprising:

a pair of substrates placed across a discharge space;

a plurality of row electrode pairs provided on one of the pair of substrates;

a plurality of column electrodes provided on the other substrate and extending in a direction at right angles to the row electrode pairs to form unit light emission areas in the discharge space respectively corresponding to the intersections with the row electrode pairs; and phosphor layers of red, green and blue colors provided in respective positions facing the respective unit light emission areas between the column electrodes and the row electrode pairs, each of the red phosphor layers being formed of a red phosphor material and making a red unit light mission area of the corresponding unit light emission area, each of the green phosphor layers being formed of a green phosphor material and making a green unit light emission area of the corresponding unit light emission area, and each of the blue phosphor layers being formed of a blue phosphor material and making a blue unit light emission area of the corresponding unit light emission area, wherein each of the phosphor layers includes a secondary electron emission material, and the secondary electron emission material is magnesium oxide including a magnesium oxide crystal body having properties of causing a cathode-luminescence emission having a peak within a wavelength range of 200 nm to 300 nm upon excitation by electron beams, the amount of the secondary electron emission material included in the green phosphor layer is larger than the amount of the secondary electron emission material included in each of the red and blue phosphor layers, and the amount of the secondary electron emission material included in the green phosphor layer is determined such that amounts of electrification of the red, green, and blue phosphor layers are substantially equal to each other.

2. A plasma display panel according to claim 1, wherein the secondary electron emission material is exposed into the inside of each of the red, green and blue unit light emission areas.

3. A plasma display panel according to claim 1, wherein the secondary electron emission material is mixed in each of the red, green and blue phosphor materials respectively forming the red, green and blue phosphor layers.

4. A plasma display panel according to claim 1, wherein the secondary electron emission material is shaped into a layer and stacked on a layer formed of each of the red, green and blue phosphor materials respectively forming the red, green and blue phosphor layers.

5. A plasma display panel according to claim 1, wherein the magnesium oxide crystal body has properties of causing a cathode-luminescence emission having a peak within a wavelength range of 230 nm to 250 nm.

6. A plasma display panel according to claim 1, wherein the magnesium oxide crystal body is a magnesium oxide single-crystal body produced by a vapor-phase oxidization technique.

7. A plasma display panel according to claim 1, wherein the magnesium oxide crystal body has a particle diameter of 2000 or more angstroms.

8. A plasma display panel, comprising:

a pair of substrates placed across a discharge space;

a plurality of row electrode pairs provided on one of the pair of substrates;

a plurality of column electrodes provided on the other substrate and extending in a direction at right angles to the row electrode pairs to form unit light emission areas in the discharge space respectively corresponding to the intersections with the row electrode pairs; and phosphor layers of red, green and blue colors provided in respective positions facing the respective unit light emission areas between the column electrodes and the row electrode pairs, each of the red phosphor layers being formed of a red phosphor material and making a red unit light emission area of the corresponding unit light emission area, each of the green phosphor layers being formed of a green phosphor material and making a green unit light emission area of the corresponding unit light emission area, and each of the blue phosphor layers being formed of a blue phosphor material and making a blue unit light emission area of the corresponding unit light emission area, wherein each of the phosphor layers includes a secondary electron emission material, and the secondary electron emission material is magnesium oxide including a magnesium oxide crystal body having properties of causing a cathode-luminescence emission having a peak within a wavelength range of 200 nm to 300 nm upon excitation by electron beams, and the amounts of the secondary electron emission material respectively included in the red phosphor layer, the green phosphor layer and the blue phosphor layer are respectively set to values that allow a voltage for a discharge initiated across the red unit light emission area between one row electrode of each row electrode pair and the column electrode, a voltage for a discharge initiated across the green unit light emission area between the row electrode and the column electrode, a voltage for a discharge initiated across the blue unit light emission area between the row electrode and the column electrode to establish a relationship of (the voltage for a discharge across the green unit light emission area)≧(the voltage for a discharge across the red unit light emission area)≧(the voltage for a discharge across the blue unit light emission area).

* * * * *